US011780651B2

(12) United States Patent
Branca et al.

(10) Patent No.: US 11,780,651 B2
(45) Date of Patent: Oct. 10, 2023

(54) CLOSURE FOR A CONTAINER AND COMPONENTS FOR A CLOSURE

(71) Applicant: AptarGroup, Inc., Crystal Lake, IL (US)

(72) Inventors: Christopher Ryan Branca, Charlotte, NC (US); Timothy Michael Mazurkiewicz, Waukesha, WI (US); Stacy L. Beilke, Eagle, WI (US); John Wisniewski, Wauwatosa, WI (US); Pranav Bhatt, Mooresville, NC (US); Chad Ryan Billsby, Sussex, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 17/577,100

(22) Filed: Jan. 17, 2022

(65) Prior Publication Data

US 2022/0227542 A1 Jul. 21, 2022

Related U.S. Application Data

(60) Provisional application No. 63/138,880, filed on Jan. 19, 2021.

(51) Int. Cl.
*B65D 41/34* (2006.01)

(52) U.S. Cl.
CPC ..... *B65D 41/3442* (2013.01); *B65D 2251/02* (2013.01); *B65D 2401/20* (2020.05)

(58) Field of Classification Search
CPC ..... B65D 41/3442; B65D 2251/02; B65D 2401/20; B65D 41/325; B65D 41/3447; B65D 55/16; B65D 2575/583; B65D 2575/586; B65D 75/5883
See application file for complete search history.

(56) References Cited

U.S. PATENT DOCUMENTS

| | | | | |
|---|---|---|---|---|
| 9,776,779 | B2 | 10/2017 | Campbell | |
| 10,562,679 | B2 | 2/2020 | Wisniewski | |
| 2013/0043206 | A1* | 2/2013 | Ochoa Laburu | B65D 47/0814 215/237 |
| 2022/0002040 | A1* | 1/2022 | Buzzi | B65D 55/16 |
| 2022/0250816 | A1* | 8/2022 | Tamarindo | B65D 55/16 |

FOREIGN PATENT DOCUMENTS

| | | | | |
|---|---|---|---|---|
| DE | 102019009027 | A1 * | 7/2021 | B65D 55/16 |
| WO | 2020089721 | A1 | 5/2020 | |
| WO | 2020166547 | A1 | 8/2020 | |

* cited by examiner

*Primary Examiner* — Shawn M Braden
(74) *Attorney, Agent, or Firm* — Wood, Phillips, Katz, Clark & Mortimer

(57) ABSTRACT

A closing element (28) for restricting communication of a substance through an access passage (34) of a body (24) includes a first portion (68) for being removably affixed to the body (24), the first portion (68) having an inner wall (80), an outer wall (96) surrounding the inner wall (80), and at least one bridge (100) connecting the outer wall (96) with the inner wall (80). The closing element (28) has a second portion (72) for being non-removably affixed to the body (24) and a movable connecting element (76) extending between the first portion (68) and the second portion (72). The closing element (28) has an unactuated configuration wherein a major portion (78) of the length of the connecting element (76) is located laterally between the inner wall (80) and the outer wall (96) to shield the major portion (78) of the length of the connecting element (76).

2 Claims, 48 Drawing Sheets

CLOSURE FOR A CONTAINER AND COMPONENTS FOR A CLOSURE

PRIORITY

This application claims priority of U.S. Provisional Patent Application No. 63/138,880, filed Jan. 19, 2021, the entire contents of which is incorporated herein by reference.

TECHNICAL FIELD

This invention relates to a closure, the components of the closure, and the package upon which the closure is installed, wherein the closure can initially prevent, but can be subsequently opened to permit, communication (e.g., flow or other movement) of a substance between the exterior and interior of a container upon which the closure is installed.

BACKGROUND OF THE INVENTION AND TECHNICAL PROBLEMS POSED BY THE PRIOR ART

Closures are employed to selectively prevent or permit communication of a substance between the exterior and interior of a container (e.g., flexible pouch, rigid bottle, machine, dispensing equipment, containment system, etc.) through an opening in the container. Various fluent and non-fluent substances (including lotions, creams, food items, granules, liquids, powders, small articles, etc.) may be packaged in a container. A typical closure includes a (1) body (e.g., pouch fitment, screw or snap-fit base, structure, etc.) located at an opening to the container interior, and (2) a closing element (e.g., a lid, cover, overcap, etc.).

The closure body can typically be either (1) a separate structure that (a) can be attached at such a container opening, and (b) defines at least one access passage through the body for communicating through such a container opening with the interior of such a container, or (2) an integral structure that is a unitary portion of such a container and that defines at least one access passage through the integral structure such that the access passage functions as the opening, per se, to the container. The closing element typically accommodates movement relative to the body access passage between (1) a closed position occluding the access passage, and (2) an open position at least partially exposing the access passage.

Such a container, the contents stored therein, the body attached or sealed at the opening of the container, and the closing element assembled in a closed position to occlude the body, may be characterized collectively as a "package."

The inventors of the present invention have determined that it would be desirable to provide an improved closing element in combination with a body to define a closure, wherein the closing element would remain with the body after opening of the closure for improved recyclability. Preferably the means for retaining the closing element would be robust and designed to survive the planned life of the closure and beyond.

It would be beneficial if such an improved closing element could meet industry standards for child choke proof safety.

It would be beneficial if such an improved closing element could provide the user with an indication or evidence of a prior attempt to open or tamper with an assembly of the closing element and the closure body.

It would additionally be beneficial if such an improved closing element could be relatively easily operated, without requiring an unusually complex manipulation or series of manipulations by a user.

It would also be beneficial if such an improved closing element could be relatively easy to manufacture and assemble with a closure body, and could also include a tether mechanism, or other connecting element that connects portions of the closing element, that is contained substantially within, or substantially shielded by, portions of the closing element to reduce the likelihood of damage during assembly and/or shipping and handling.

Further, it would be desirable if such an improved closing element could be opened or operated without generating smaller, separate waste pieces or sharp edges.

The inventors of the present invention have further determined that, for at least some applications, it may be desirable to provide such an improved closing element that can be easily stored in an open position that does not interfere with, or obstruct, a user's lips when the user is drinking from a package containing the closing element.

The inventors of the present invention have also determined that it would be desirable to provide, at least for some applications, an improved assembly of a closing element and a closure body that are made from the same polymer as the container upon which they are installed to achieve mono material package recyclability.

The inventors of the present invention have also discovered that it would be desirable to provide, at least for some applications, an improved assembly of a closing element, a closure body, and a package that can be manufactured and/or assembled at a relatively low cost, and can accommodate manufacture by means of efficient, high-quality, large-volume techniques, and that can facilitate the minimization of plastic and part weight.

The inventors of the present invention have discovered how to provide such an improved closing element, closure body, and/or package that includes novel, advantageous features not heretofore taught or contemplated by the prior art, and which can accommodate designs having one or more of the above-discussed benefits or features.

SUMMARY OF THE INVENTION

In accordance with one broad form of the invention, a closing element for restricting communication of a substance through an access passage of a body is provided. The closing element has a first portion for being removably affixed to the body. The first portion includes an inner wall having an open end for receiving a portion of the body and a closed end for occluding the access passage of the body. The first portion includes an outer wall surrounding the inner wall and at least one bridge connecting the outer wall with the inner wall. The closing element includes a second portion for being non-removably affixed to the body and a movable connecting element extending between the first portion and the second portion. The closing element has an unactuated configuration wherein a major portion of the length of the connecting element is located laterally between the inner wall and the outer wall to shield the major portion of the length of the connecting element.

According to one preferred form of the invention, the connecting element has a first leg connected to the first portion, a second leg connected to the second portion, and a hinge connecting the first leg and the second leg. The hinge is located laterally between the inner wall and the outer wall in the unactuated configuration of the closing element.

According to another form of the invention, the closing element is provided in combination with a body on which the closing element is assembled to form a closure. The body has a base portion for being located at an opening of a container and a spout portion extending from the base portion and affixed to the second portion of the closing element. The body includes an access passage extending through the base portion and the spout portion to accommodate the flow of a fluent substance through the body. In one preferred form of the invention, the base portion of the body is a fitment for use with a container that is a flexible pouch having an opening, and the body has a plurality of ribs for being sealed at the opening of the flexible pouch.

According to yet another preferred form of the invention, the first portion and the second portion are connected by at least one frangible element for being broken by a predetermined amount of relative axial movement between the first portion and the second portion of the closing element. In one preferred form of the invention, the first portion and the second portion of the closing element are connected by a plurality of frangible elements defining a plurality of apertures located between adjacent ones of the plurality of frangible elements. Preferably, the each one of the plurality of apertures has a circular central portion and a pair of opposite, tapered ends.

In yet another aspect of the present invention, the outer wall of the first portion has a notch for receiving a part of a container to removably secure the first portion of the closing element to the container. Preferably, the closing element defines a central axis extending between the first portion and the second portion in the unactuated configuration and the notch is located axially above, and proximate to, the connecting element in the unactuated configuration. In one presently preferred form of the invention, the notch includes a pair of tapering, opposing surfaces. In yet another preferred form of the invention, the notch includes a pair of opposing surfaces. One of opposing surfaces includes a projection and the other one of the opposing surfaces includes a recess facing the projection.

In yet another form of the present invention, the closing element is provided in combination with a body that includes a spout portion defining a body thread. The closing element defines a closing element thread. The body thread and the closing element thread are configured to effect controlled, relative axial movement between the body and the first portion of the closing element.

In another form of the present invention, the closing element is provided in combination with a body sealed at an opening of a container of a fluent substance. The closing element, the body, and the container of the fluent substance together form a package.

According to one form of the invention, the closing element defines a central axis extending between the first portion and the second portion in the unactuated configuration. The connecting element has a first leg connected to the first portion, a second leg connected to the second portion, and a hinge connecting the first leg and the second leg. The hinge is located axially outwardly of the second portion, along the central axis, with the closing element in the unactuated configuration.

According to still another form of the invention, the closing element defines a central axis extending between the first portion and the second portion in the unactuated configuration. The connecting element has a first leg connected to the first portion, a second leg connected to the second portion, and a hinge connecting the first leg and the second leg. The hinge is located axially inwardly of the closed end of the inner wall, relative to the central axis, with the closing element in the unactuated configuration.

In still another form of the present invention, the closing element is provided in combination with a body that is either: a separate structure that can be attached to a container at an opening of the container; or an integral structure that is a unitary portion of a container.

In accordance with another broad form of the invention, a closing element for restricting communication of a substance through an access passage of a body is provided. The closing element has a first portion for being removably affixed to the body. The first portion includes an inner wall having an open end for receiving a portion of the body and a closed end for occluding the access passage of the body. The first portion includes an outer wall surrounding the inner wall and at least one bridge connecting the outer wall with the inner wall. The outer wall has a notch for receiving a part of a container to removably secure the first portion of the closing to the container.

In accordance with another broad form of the invention, a closing element for restricting communication of a substance through an access passage of a body is provided. The closing element has a first portion for being removably affixed to the body. The first portion includes an inner wall having an open end for receiving a portion of the body and a closed end for occluding the access passage of the body. The first portion includes an outer wall surrounding the inner wall and at least one bridge connecting the outer wall with the inner wall. The closing element includes a second portion for being non-removably affixed to the body and a movable connecting element extending between the first portion and the second portion. The first portion and the second portion are connected by a plurality of frangible elements defining a plurality of apertures between adjacent ones of the plurality of frangible elements. Each one of the plurality of apertures includes a circular central portion and a pair of opposite, tapered ends.

In accordance with yet another broad form of the invention, a method of opening a package is disclosed, wherein the package includes a container that is a flexible pouch defining an opening to an interior containing a substance, a body sealed at the opening of the flexible pouch and having an access passage to accommodate the communication of the substance through the body, and a closing element assembled with the body to restrict communication of the substance through the access passage of the body. The closing element has a first portion removably affixed to the body. The first portion includes an inner wall having an open end for receiving a portion of the body and a closed end for occluding the access passage of the body. The first portion includes an outer wall surrounding the inner wall and at least one bridge connecting the outer wall with the inner wall. The outer wall has a notch for receiving a part of the flexible pouch to removably secure the first portion of the closing element to the pouch. The closing element includes a second portion for being non-removably affixed to the body and a movable connecting element extending between the first portion and the second portion. The method includes the step of gripping the outer wall of the closing element to move the first portion of the closing element away from the second portion of the closing element and the access passage of the body. The method includes the step of inverting the first portion of the closing element and the step of inserting a part of the flexible pouch within the notch to secure the first portion of the closing element by frictional engagement to the flexible pouch.

Other objects, features, and advantages of the invention will become apparent from a review of the entire specification, including the appended claims and drawings.

BRIEF DESCRIPTION OF THE DRAWINGS

FIG. 6 shows the frangible elements broken upon axial movement of the closing element away from its unactuated configuration (the connecting element of the closing element being omitted from FIG. 6);

FIG. 8 shows the frangible elements broken upon axial movement of the closing element away from its unactuated configuration and a first portion of the closing element inverted in an open condition of the closure;

FIG. 14 shows the frangible elements broken upon axial movement of the closing element away from its unactuated configuration and a first portion of the closing element moved away from a second portion of the closing element;

FIG. 21 shows the closure in a fully open condition with a first portion of the closing element inverted and coupled with a sealed edge of the pouch;

FIG. 29A shows the frangible elements broken upon movement of the closing element away from the fully closed condition of the closure, and a first portion of the closing element is inverted and resting against a rear side of the pouch in one example of a fully open condition;

FIG. 30 illustrates the closing element in its as-molded, unactuated configuration;

FIG. 37 illustrates the closing element in its as-molded, unactuated configuration;

DESCRIPTION OF THE PREFERRED EMBODIMENTS

While this invention is susceptible of embodiment in many different forms, this specification and the accompanying drawings disclose only some specific forms as examples of the invention. However, the invention is not intended to be limited in its broadest form to just the embodiments so described. The scope of the invention is pointed out in the appended claims.

Figure 29A:
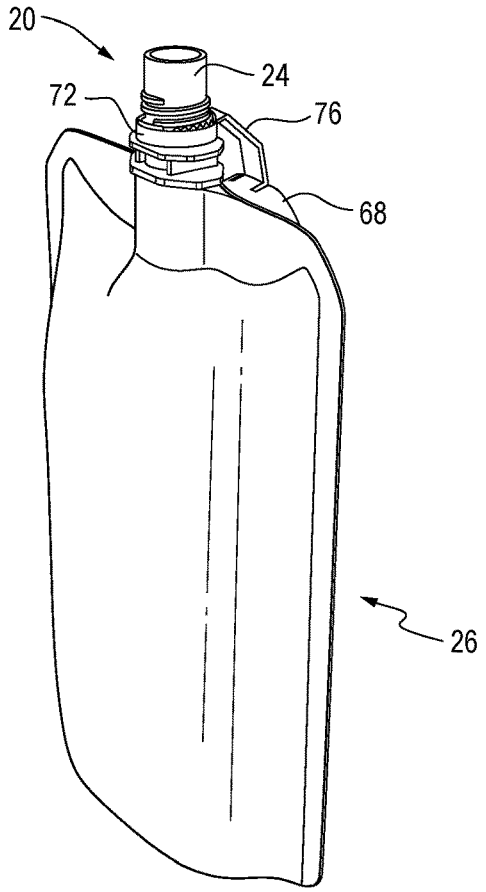
FIG. 29A is an isometric view, from the top front and right side, of the closure of FIG. 1 with the body of the closure installed at the opening of a container in the form of a flexible pouch—the closure, pouch, and contents therein defining a package.
Figure 29B:
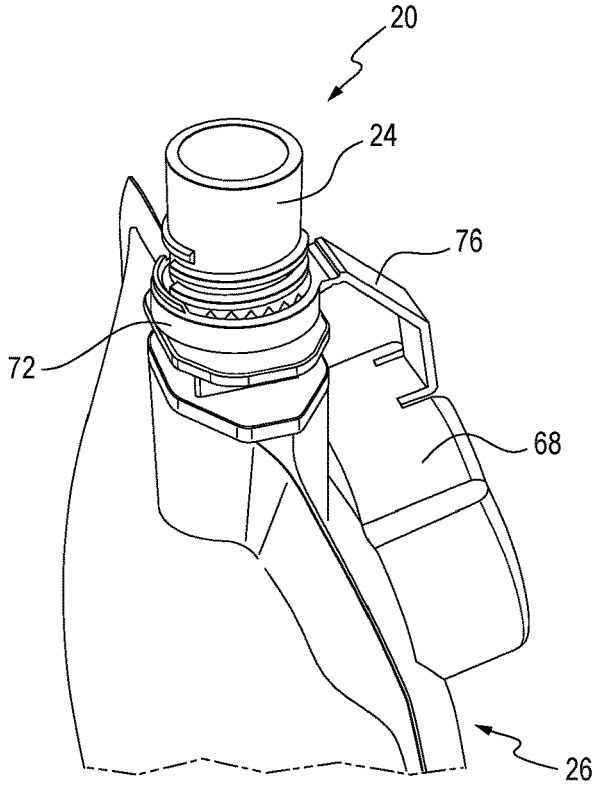
FIG. 29B is a partial, isometric view, from the top front and right side, of the package of FIG. 29A.
Figure 29C:
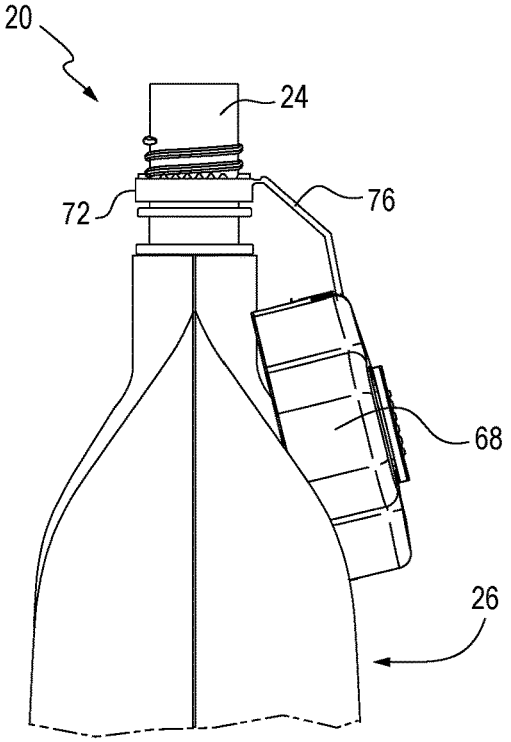
FIG. 29C is a partial, right side elevational view, of the package of FIG. 29A.
Figure 29D:
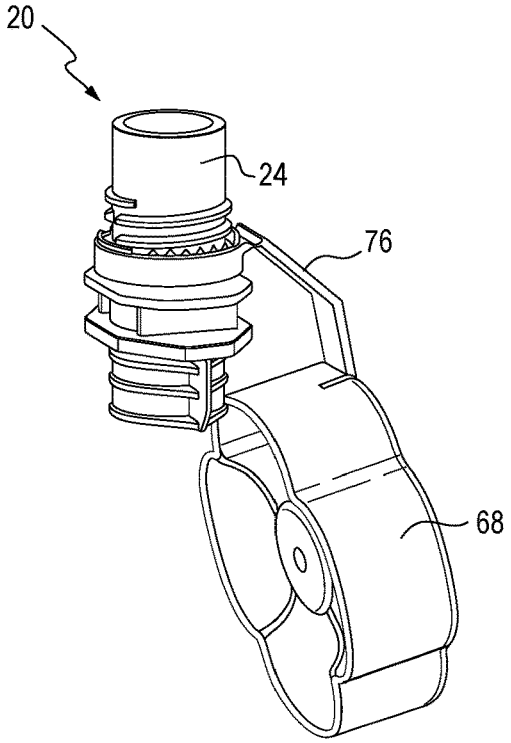
FIG. 29D is a partial, isometric view, from the top front and right side, of only the closure of FIG. 29A.
Figure 30:
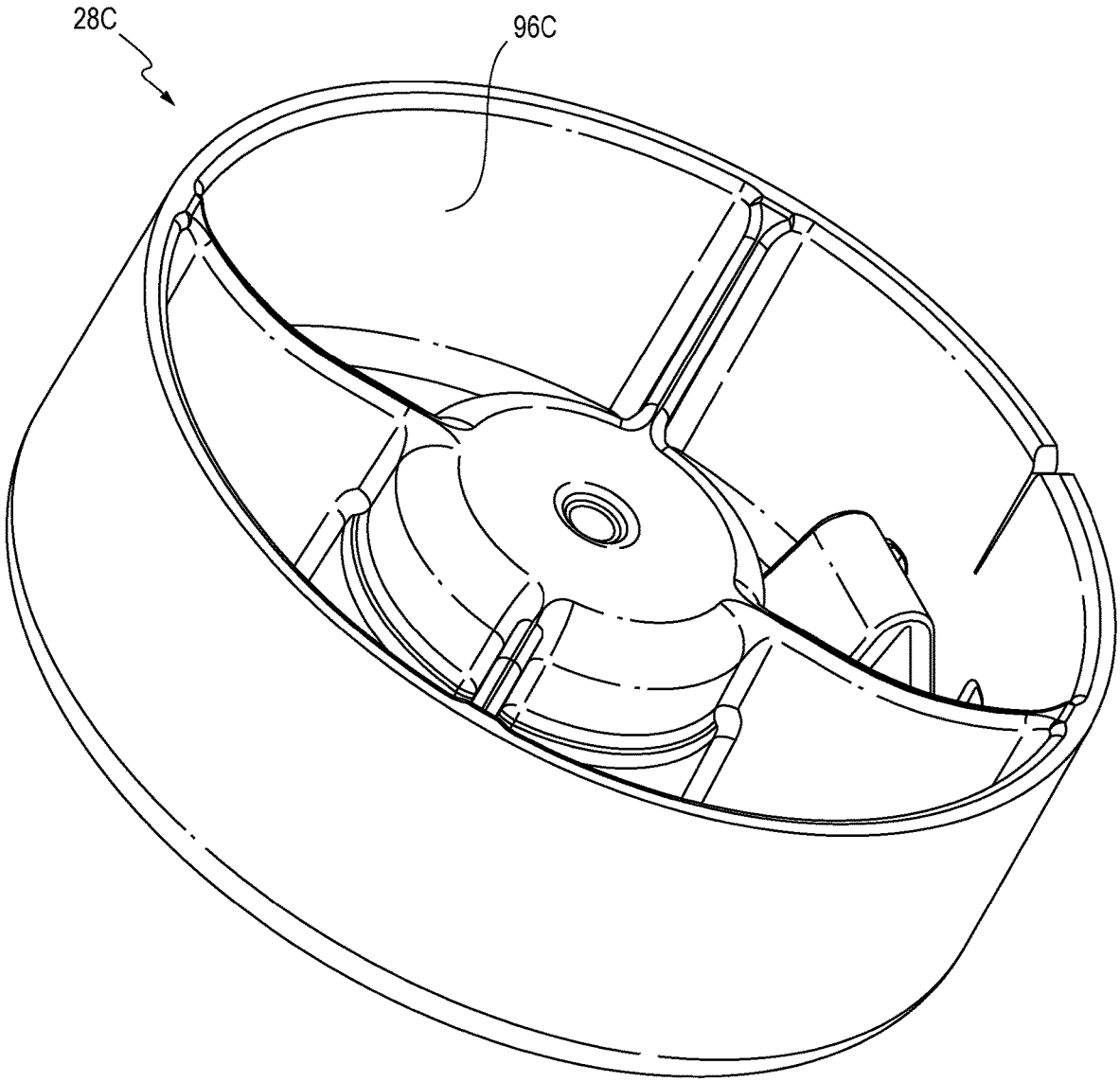
FIG. 30 is an isometric view, from the top front and right side, of another embodiment of a closing element according to the present invention for use with a body to form a closure.
Figure 31:
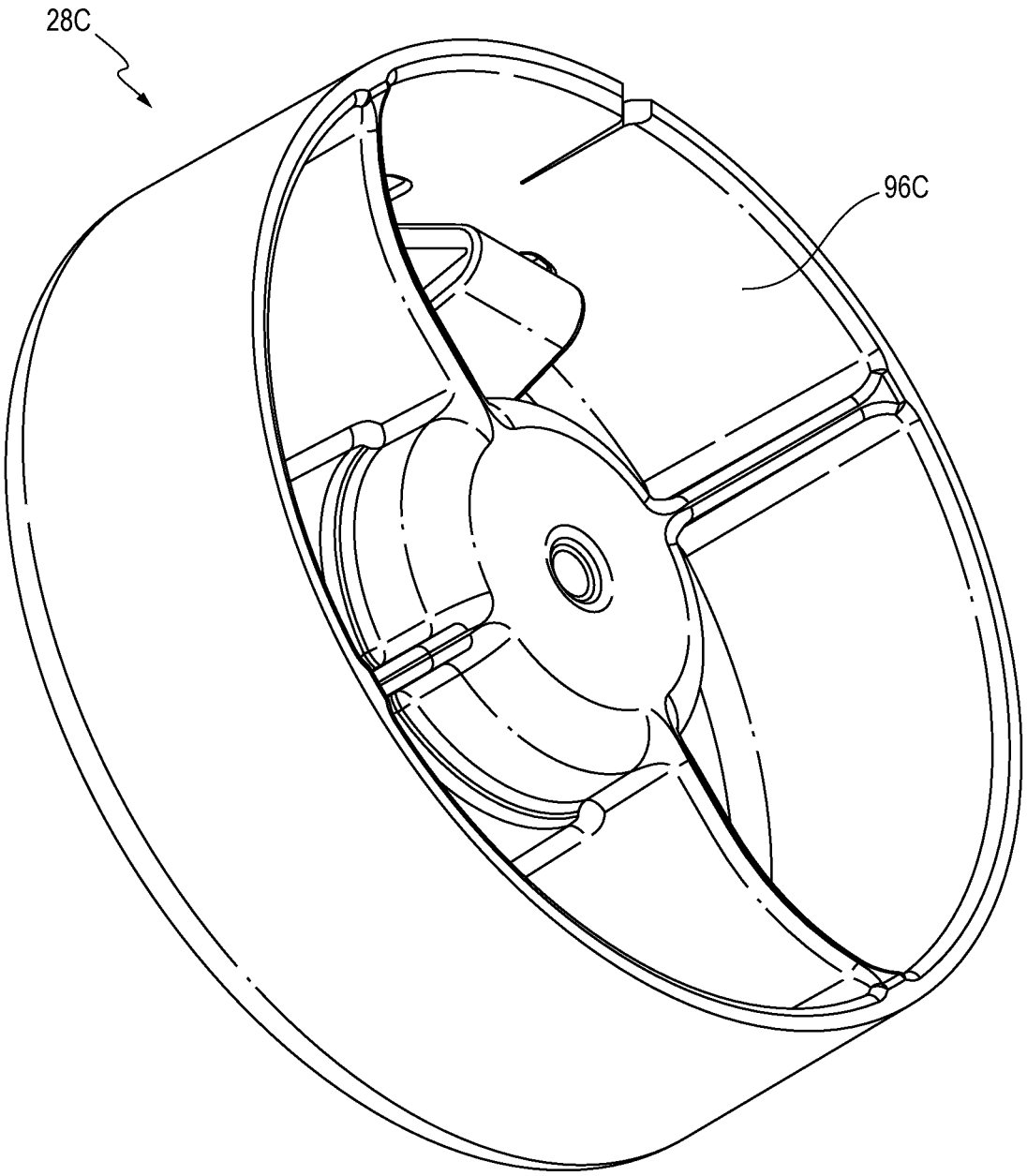
FIG. 31 is an isometric view, from the top front and left side, of the closing element of FIG. 30.
Figure 32:
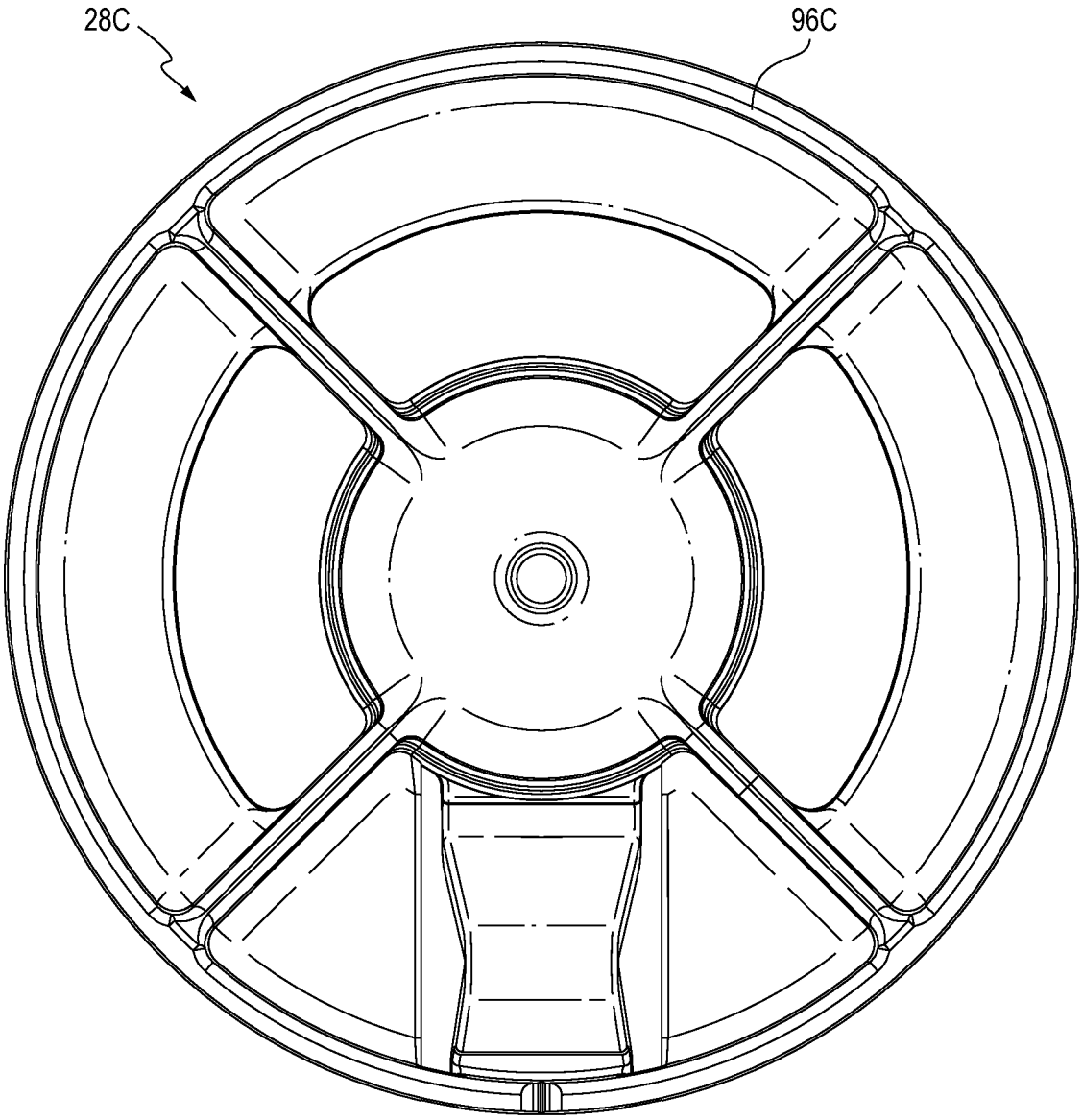
FIG. 32 is a top plan view, rotated 180 degrees, of the closing element of FIG. 30.
Figure 33:
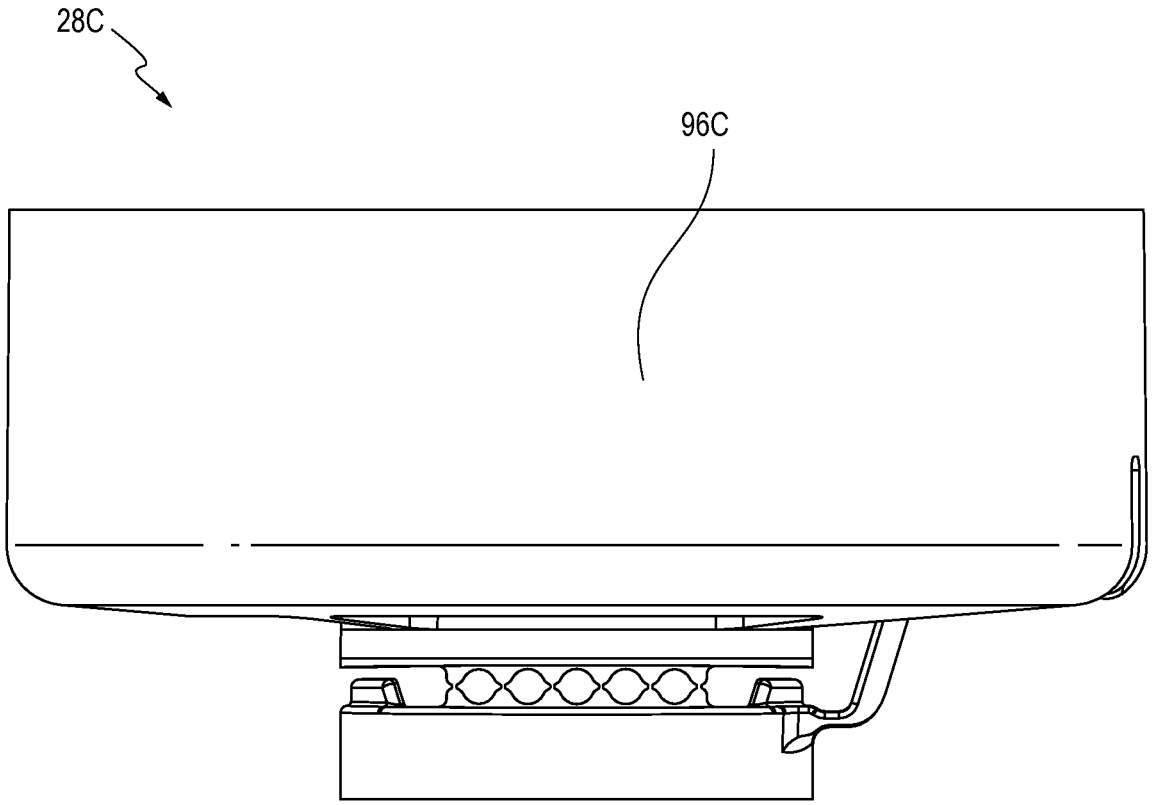
FIG. 33 is a right side elevational view of the closing element of FIG. 30.
Figure 34:
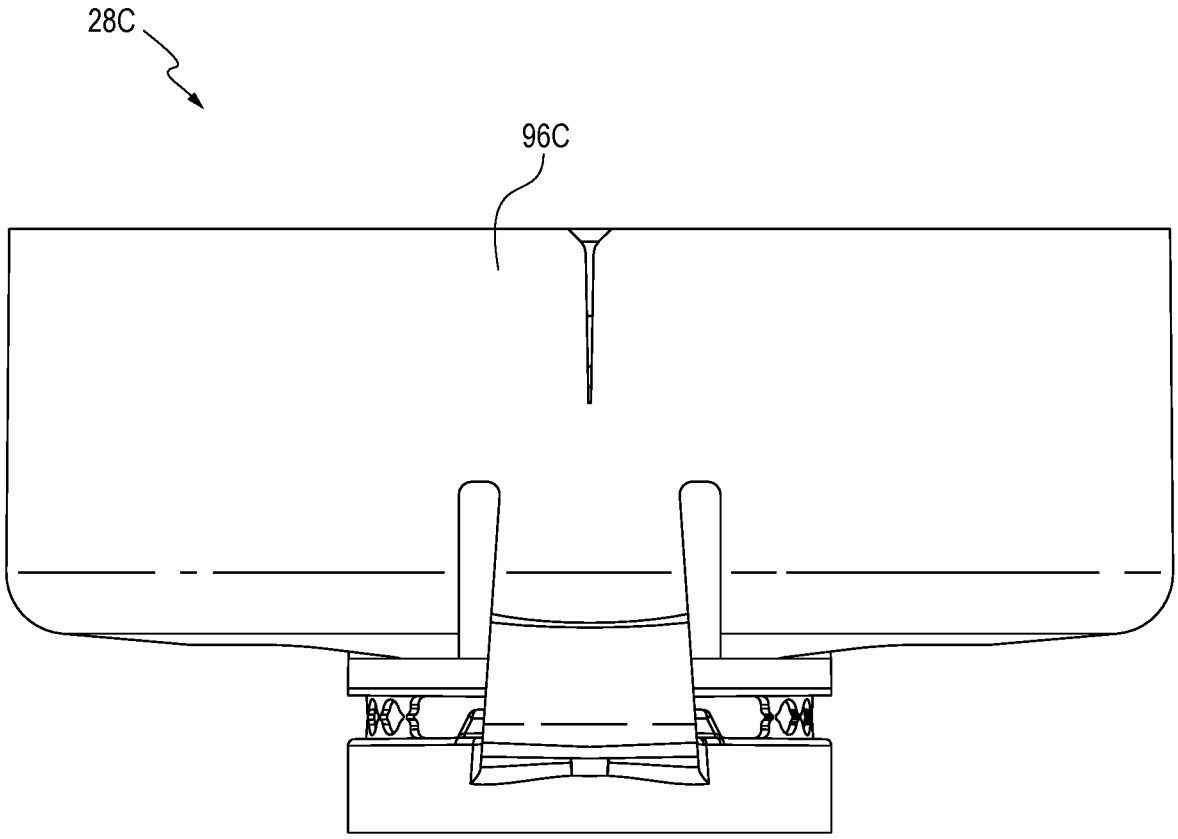
FIG. 34 is a rear elevational view of the closing element of FIG. 30.
Figure 35:
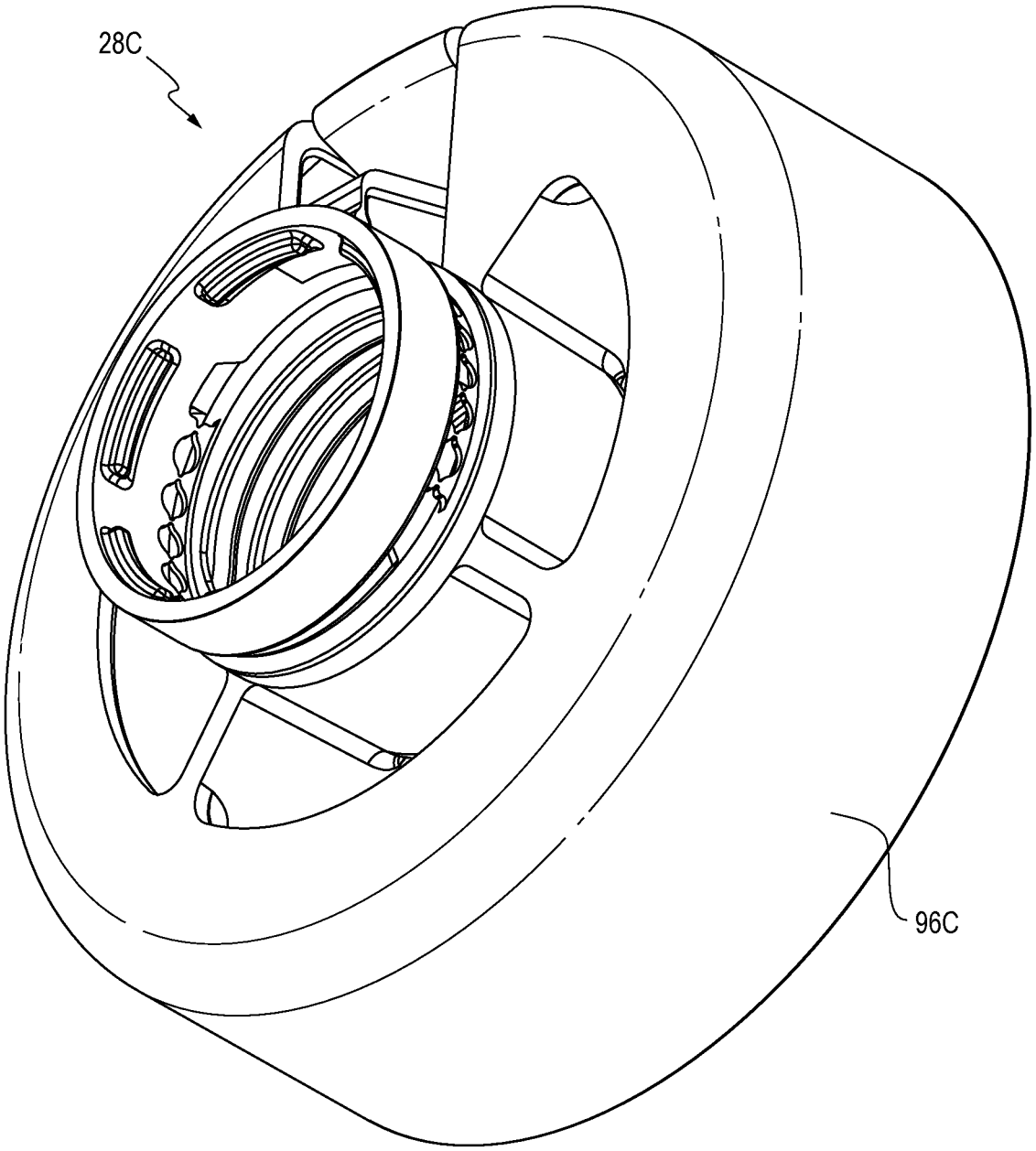
FIG. 35 is an isometric view, from the bottom front and left side, of the closing element of FIG. 30.
Figure 36:
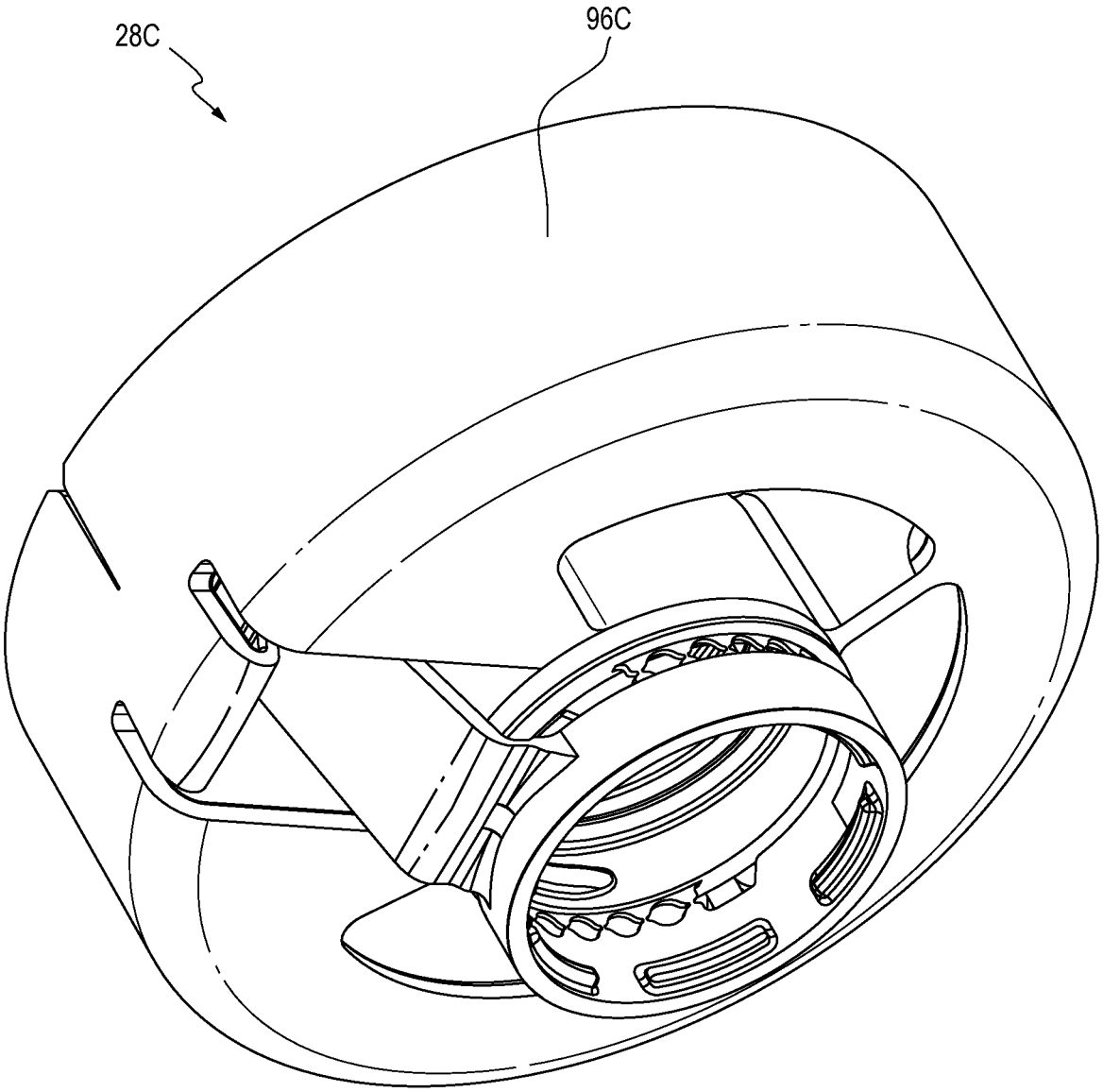
FIG. 36 is an isometric view, from the bottom rear and left side, of the closing element of FIG. 30.
Figure 37:
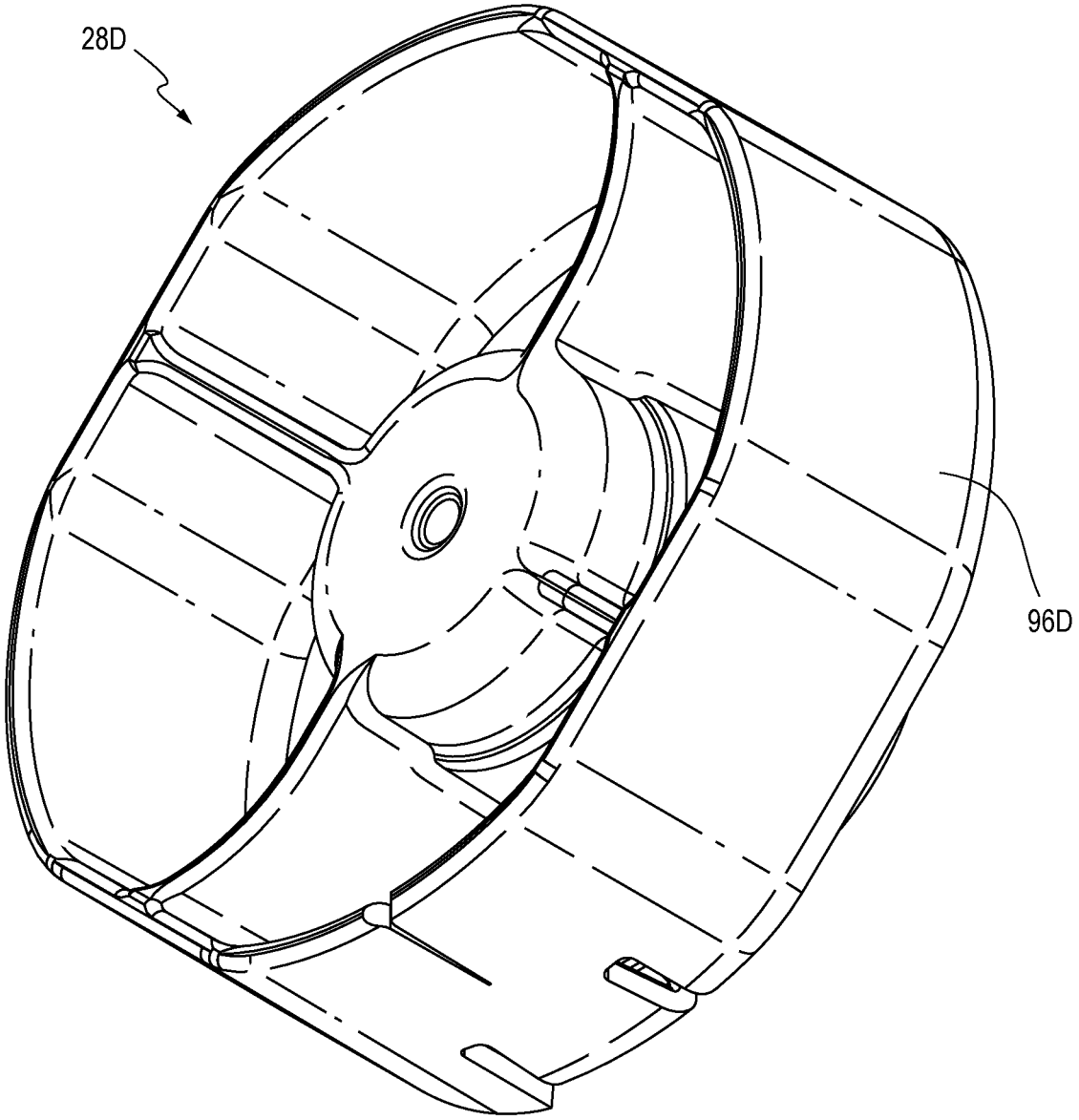
FIG. 37 is an isometric view, from the top rear and left side, of still another embodiment of a closing element according to the present invention for assembly with a body to form a closure.
Figure 38:
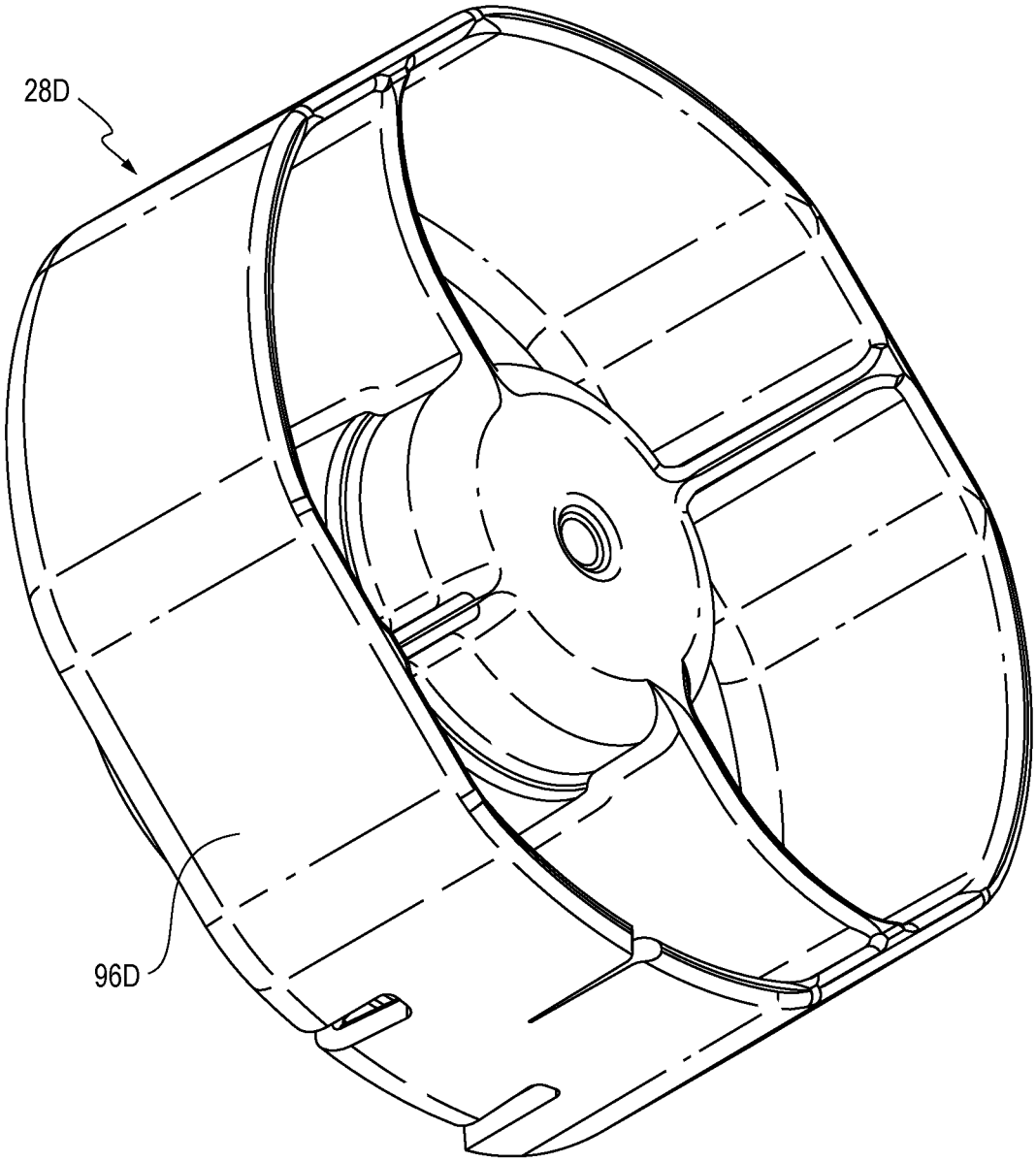
FIG. 38 is an isometric view, from the top rear and right side, of the closing element of FIG. 37.
Figure 39:
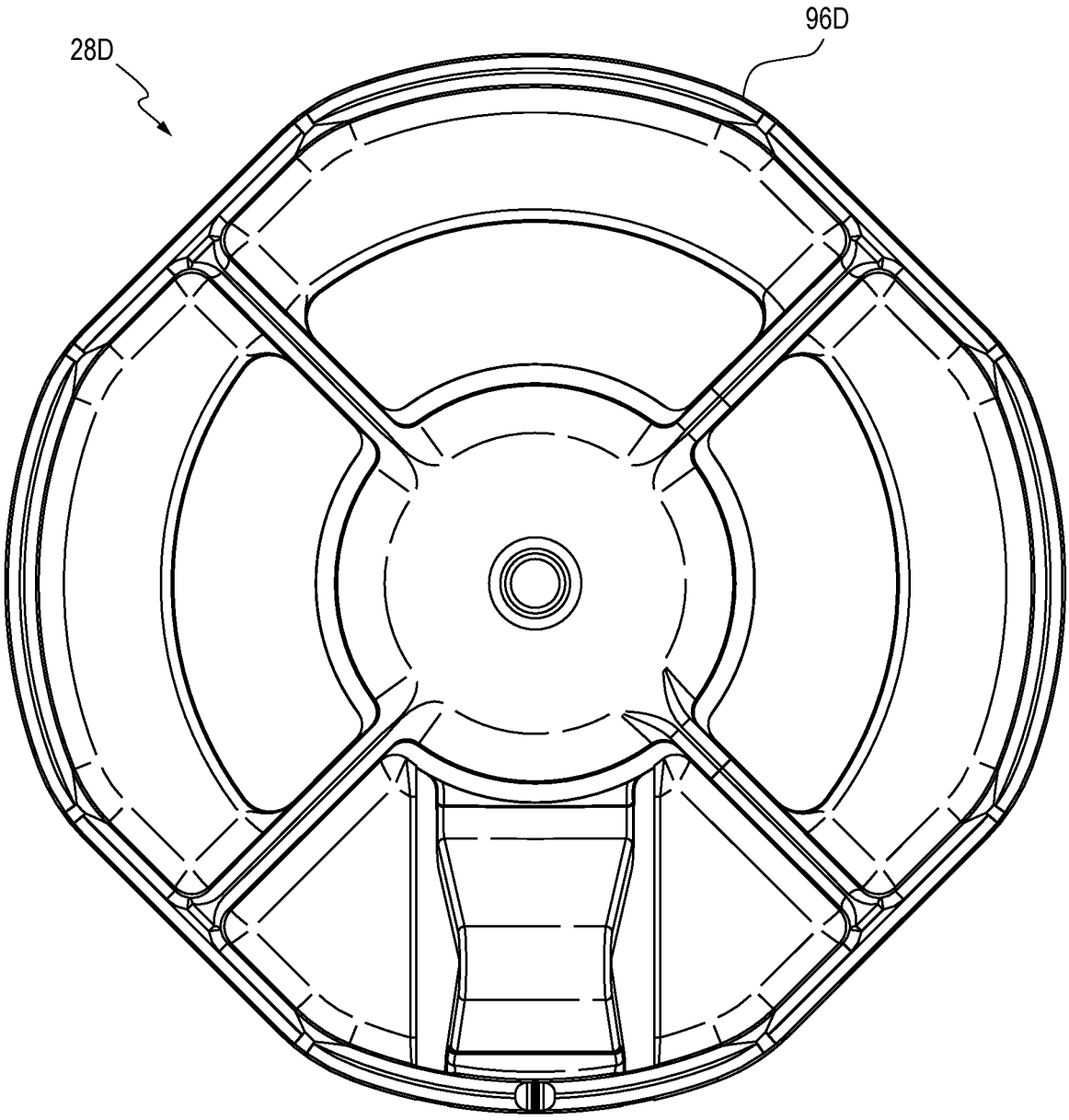
FIG. 39 is a top plan view, rotated 180 degrees, of the closing element of FIG. 37.
Figure 40:
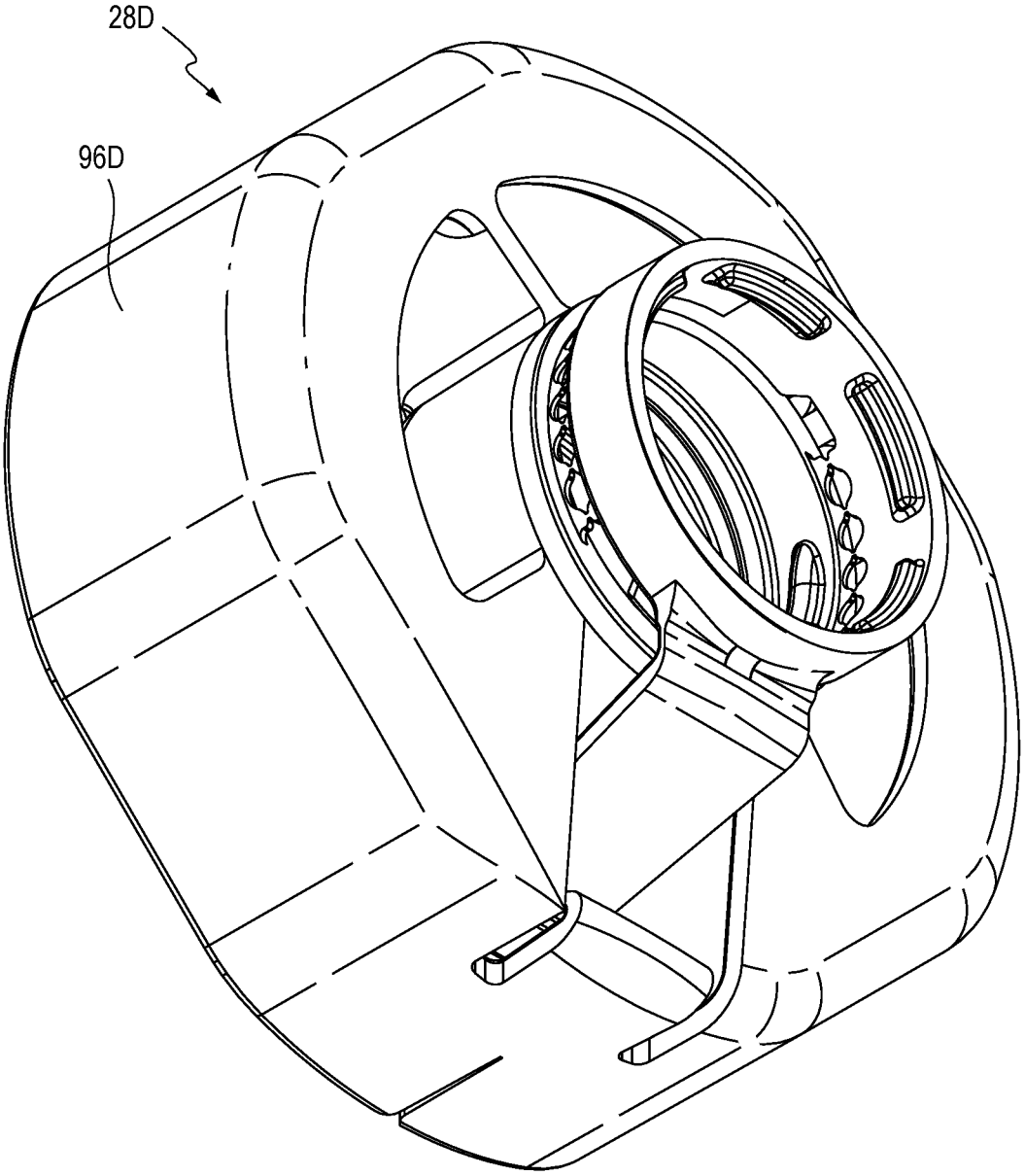
FIG. 40 is an isometric view, from the bottom rear and right side, of the closing element of FIG. 37.
Figure 41:
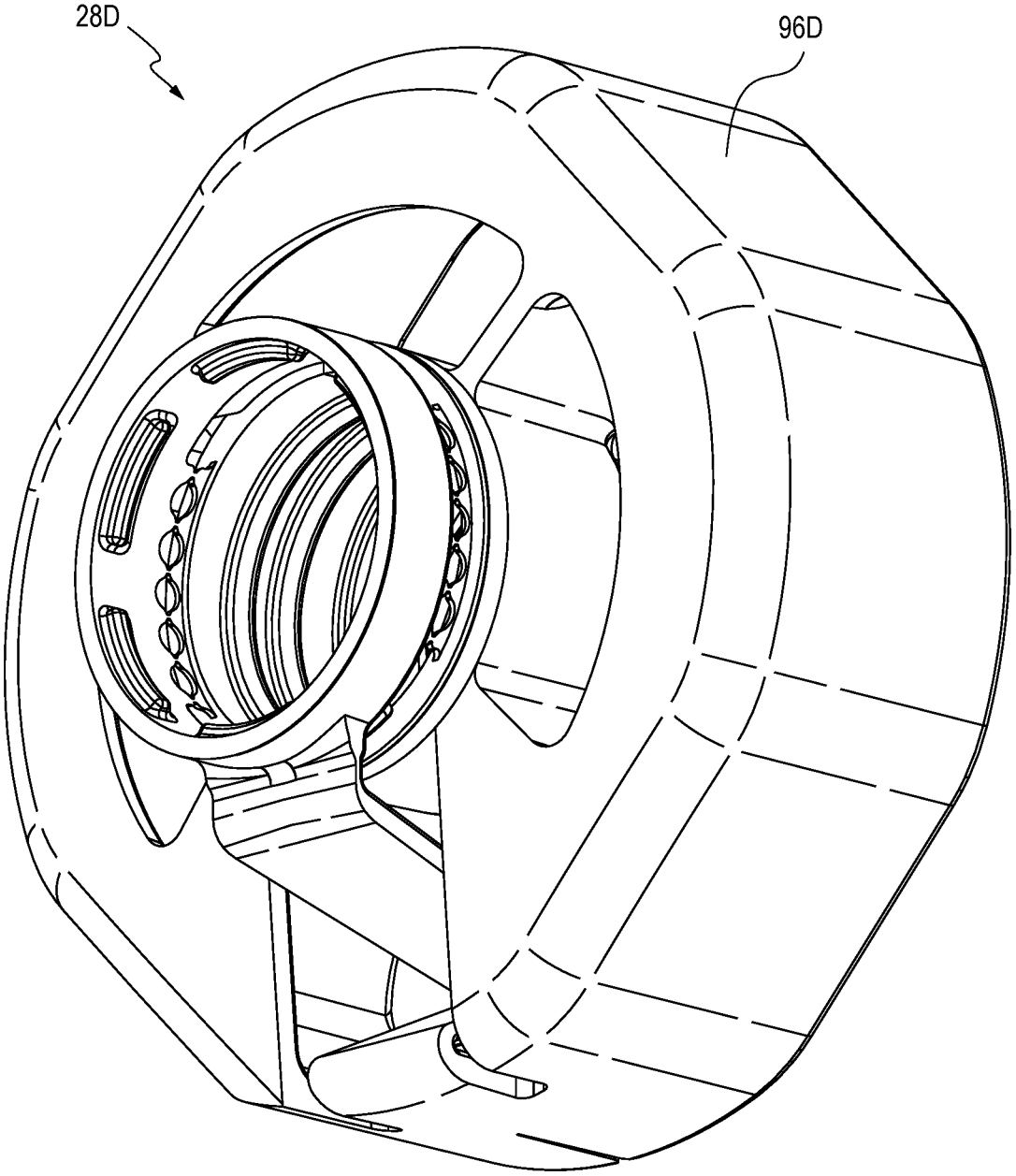
FIG. 41 is an isometric view, from the bottom rear and right side, of the closing element of FIG. 37.

For ease of description, the closing element of this invention, is described in a typical (upright) position, that the closing element would have when installed on a closure body in the form of a closure at the opening of an upright container of a substance or product (the container being illustrated in the form of an upright flexible pouch in FIGS. 21 and 29A), and terms such as upper, lower, radial, axial, above, below, lateral, etc., are used with reference to this position. It will be understood, however, that the closing element and the assembly of the closure embodying this invention may be manufactured, stored, transported, used, and sold in an orientation other than the position described.

The closing element of the present invention is suitable for use with a variety of conventional or special containers, the details of which, although not fully illustrated or described, would be apparent to those having skill in the art and an understanding of such containers. The particular containers, per se, that are described herein form no part of, and therefore are not intended to limit, the broad aspects of the present invention.

The illustrated embodiments of the closing element will typically be used with a body in the form of a closure that is installed on a container of a material or substance (e.g., a product such as a lotion, fluent food, or drink substance) that can be dispensed, or otherwise removed, from the container through the opened closure. The product may be, for example, a fluent substance such as a liquid, cream, powder, slurry, or paste. If the container and closure are large enough, then the product could also be non-fluent, discrete pieces of material (e.g., food products such as nuts, candies, crackers, cookies, etc., or non-food products including various items, particles, granules, etc.) which can be removed through an open closure by hand from a container, or scooped out of a container, or poured out of a container. Such materials may be, for example, a food product, a personal care product, an industrial product, a household product, or other types of products. Such materials may be for internal or external use by humans or animals, or for other uses (e.g., activities involving medicine, manufacturing, commercial or household maintenance, construction, agriculture, etc.).

FIGS. 1-27 illustrate a first preferred embodiment of a closure 20 incorporating an overcap or closing element 28 according to the present invention. The closure 20 has the basic components of a body 24 for being located at the opening of a container 26 (e.g., FIGS. 21-27) and a closing element 28 having a portion for being fixedly attached to the body 24 and having another portion for being removably attached to the body 24. The body 24 defines a passage (described in detail hereinafter) through which a substance can flow or otherwise move. In the illustrated first embodiment, the closure 20 is provided in the form of a separate article which is especially suitable for being attached to the container 26 that would typically contain contents such as a product or products consisting of articles or fluent material. Such a container 26 could be a collapsible, flexible pouch as illustrated in FIGS. 21-27. With appropriate modification to the body 24, the container 26 may be a generally rigid container (not illustrated) which may have somewhat flexible, resilient walls, such as a bottle or tank.

However, it will be understood that the container 26 could may be some other type of container or vessel for a substance, which may include, or be part of, for example, a medical device, processing machine, dispenser, reservoir on a machine, etc., wherein the container 26 has an opening to the container interior. The container 26, per se, such as a bottle, pouch, or other vessel, per se, does not form a part of the broadest aspects of the present invention, per se. The container 26 may have any configuration suitable for the intended use.

The container 26, or a portion thereof, may be made from a material suitable for the intended application (e.g., a thin, flexible material for a pouch wherein such a material could be a polyethylene terephthalate (PET) film or a polyethylene film, or a thicker, less flexible material for a bottle wherein such a less flexible material could be injection-molded polyethylene or polypropylene).

In applications wherein the body 24 of the closure 20 is mounted to a container 26 such as a bottle (not illustrated) or pouch (e.g., FIGS. 21-27), it is contemplated that typically, after the closure manufacturer makes the closure 20 (e.g., by molding the closure components (i.e., the closing element 28 and the body 24) from a thermoplastic polymer and assembles them together in an initially assembled orientation defining a closed position or condition), the closure manufacturer will then ship the closed closure 20 to a filler facility at another location where the container 26 is either manufactured or otherwise provided, and where the container 26 is filled with a product. However, for some applications, the components of the closure 20 could be shipped by the manufacturer in an unassembled condition to the filler facility.

If the container 26 is a collapsible pouch as illustrated, then the closure body 24 may include a suitable conventional or special fitment portion (as illustrated and as will be discussed in detail below) that can be attached to the pouch as the pouch is being made and filled, or as the pouch is being made but before the pouch is subsequently filled through the body 24 of the unassembled closure 20 or through open regions of the pouch walls that are later sealed closed.

In the first illustrated embodiment, the closure 20 is preferably provided as an assembly of the closing element 28 and body 24 that together define an article (i.e., the closure 20) for being attached to a container 26. The first illustrated preferred embodiment of the closure 20 is especially suitable for being non-removably attached (e.g., mounted or installed) on a container 26 in the form of a pouch or bottle. However, it will be appreciated that in some applications (not illustrated), it may be desirable for the closure 20 to be attached to a container 26 in a manner that would allow a user to remove the closure 20 from the container 26. Further, it may be desirable for the closure 20 (or at least the body 24 of the closure 20) to be formed as an integral, unitary part, or extension, of the container 26 (e.g., a pouch or bottle) wherein such a unitary part or extension also (i.e., simultaneously) defines an end structure (or other portion) of the container 26, per se. In one form, the body 24 could encompass the entire container 26, per se.

The first illustrated embodiment of the closure 20, if initially manufactured and provided separately from the pouch type container 26, is adapted to be subsequently attached to the pouch type 26 at an opening in the container 26 which provides access from the exterior environment to the container interior and to the product contained therein after a portion of the closure 20 (e.g., the closing element 28) is opened as described hereinafter.

Where the container 26 is a bottle (not illustrated), the bottle typically includes an upper end portion or other suitable structure on some part of the bottle that defines the bottle mouth portion (i.e., a portion that defines an opening to the bottle interior), and such a mouth portion of a bottle typically has a cross-sectional configuration with which the closure 20 is designed to engage. For example, the bottle mouth could have a configuration of the upper end of the body 24, and the closing element 28 could be directly mounted thereon. The main body portion of the bottle may have a cross-sectional configuration that differs from the cross-sectional configuration of the bottle mouth portion. On the other hand, the bottle may instead have a substantially uniform shape along its entire length or height without any portion of reduced size or different cross-section. The bottle may have a generally rigid or flexible wall or walls which can be grasped by the user.

The particular first embodiment of the closure 20 illustrated in the FIGS. 1-13 and 21-27 is especially suitable for use with a container 26 that is either a collapsible, flexible pouch or a bottle (not illustrated) having a substantially flexible wall or walls that can be squeezed or deflected laterally inwardly by the user to increase the internal pressure within the bottle so as to force the product out of the bottle and through the opened closure. In a bottle with a flexible wall or walls, such a flexible wall or walls typically have sufficient, inherent resiliency so that when the squeezing forces are removed, the bottle walls return to the normal, unstressed shape.

In other applications it may be desirable to employ a generally rigid container 26, and to pressurize the container interior at selected times with a piston or other pressurizing system to force the product out through the open closure, or to reduce the exterior ambient pressure so as to suck the product out through the open closure 20.

In the illustrated first embodiment, the closure 20 includes a specially configured closure body 24 and a closing element 28 which has (i) a non-removable portion adapted to be installed on the body 24, and (ii) a removable portion which is adapted to be installed on the body 24 and which can be separated from, but remains tethered to, the body 24. As explained hereinafter, the user's initial or partial opening of the closure 20 will permanently alter the physical condition of the closing element 28 so as to create or provide a "tamper-evident" indication to subsequent users of the initial opening or partial opening of the closure 20.

The closure body 24 and the closing element 28 are each preferably molded from a suitable thermoplastic material such as polyethylene, polypropylene, or the like. In a presently preferred form of the closure 20, the body 24 and closing element 28 are preferably each molded separately as a unitary structure from the same thermoplastic material (i.e., the same resin identification number) as the container 26 to facilitate easier recycling. Other materials may be employed instead.

FIGS. 1-5 illustrate the assembled closure 20 in an initial, fully closed condition with the closing element 28 installed on the body 24. FIGS. 1-5 may be characterized as also illustrating the closing element 28 and body 24 in an initially assembled orientation which prevents, but can be subsequently operated to permit, communication of a substance through the body 24. Typically, in order to permit communication through the closure 20, an upper portion of the closing element 28 is ultimately separated by the user from the body 24. In the preferred embodiment illustrated in FIGS. 1-5, an upper portion of the closing element 28 is unscrewed from the body 24 and lifted away so as to afford sufficient access to the body 24.

Figure 4:
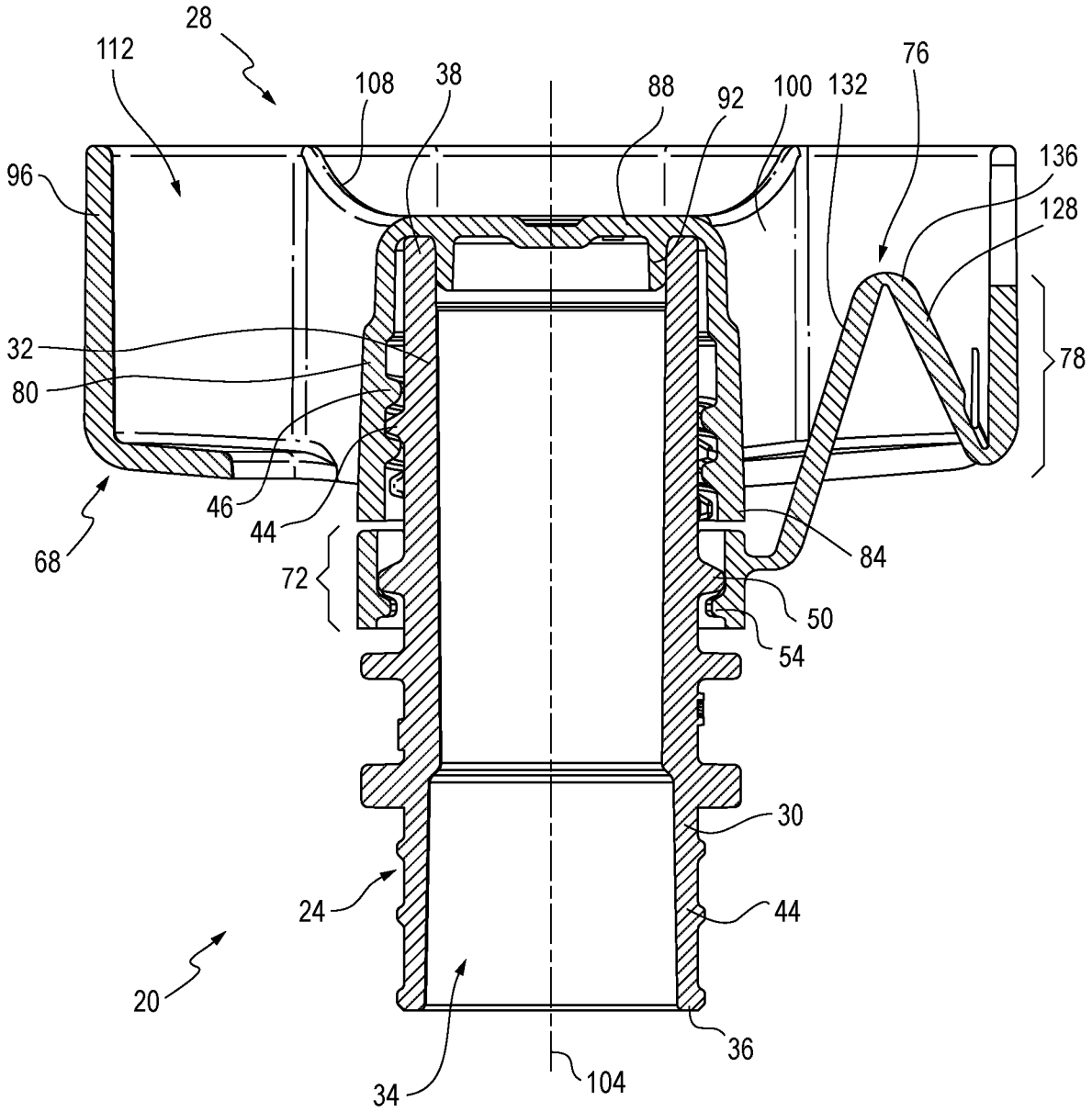
FIG. 4 a cross-sectional view of the closure shown in FIG. 1, taken generally along a vertical plane extending through the center of the connecting element.
Figure 5:
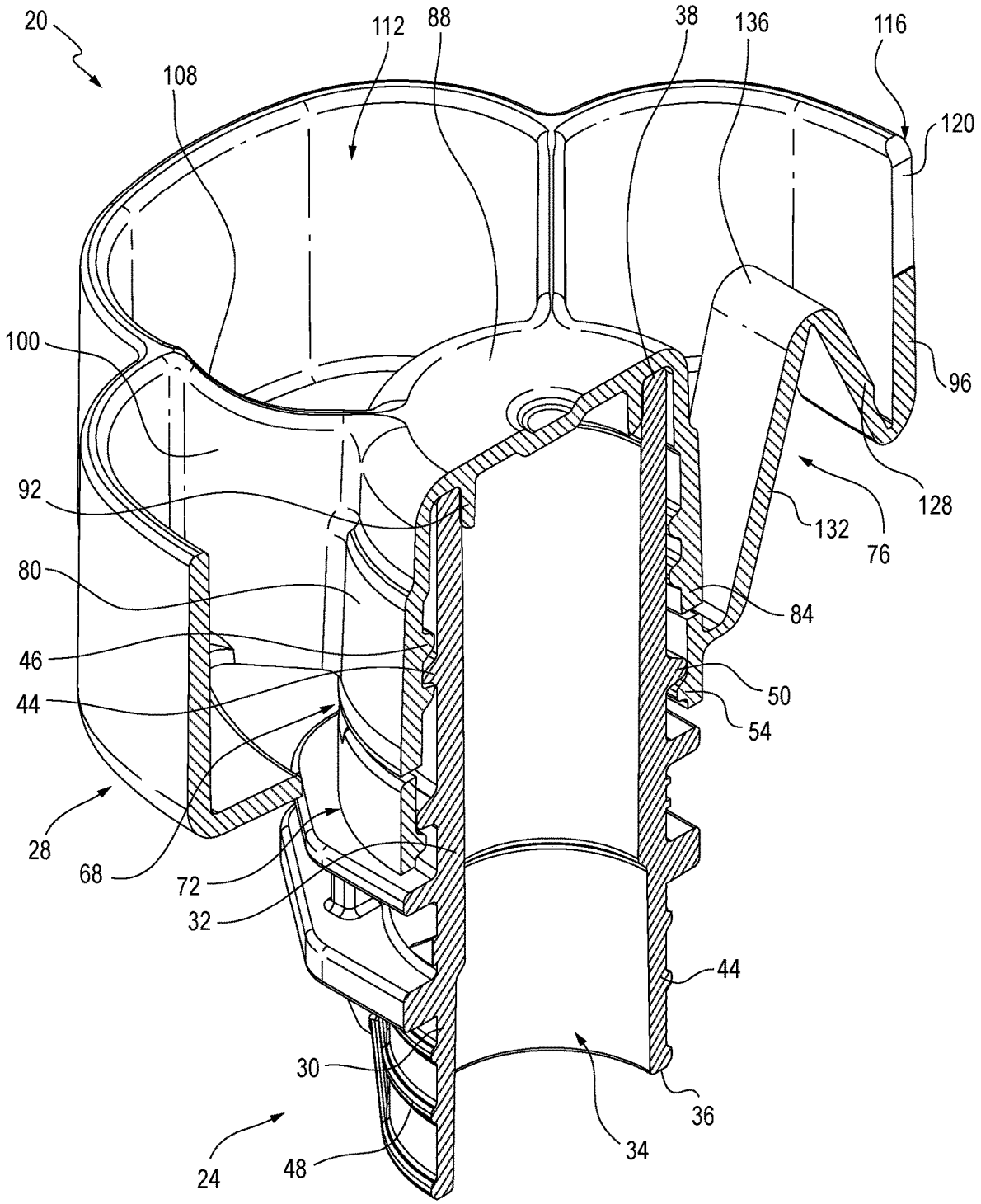
FIG. 5 is an isometric, cross-sectional view of the closure shown in FIG. 4.

With reference to FIGS. 4 and 5, the body 24 includes a base portion 30 for being connected or sealed to the pouch type container 26 (FIG. 21) and a spout portion 32 extending from the base portion 30. The body 24 defines an internal access passage 34 through the base portion 30 and the spout portion 32, the access passage 34 having an open proximal end 36 for receiving a product from the interior of the container 26 (FIG. 21) and having a distal open end 38 from which a product can be discharged. The term "spout" is used herein in the sense of a tall or a short, upwardly (i.e., axially outwardly) extending boss or other structure defining the access passage 34.

With reference now to FIGS. 4 and 5, the spout portion 32 also includes one of a cam or cam follower, such as the illustrated helical thread 44 on the body 24 and the thread 46 on the closing element 28. The body thread 44 could be regarded as either a cam per se or a cam follower per se for engaging a thread 46 on the closing element 28 as described hereinafter. That is, if the body thread 44 is regarded as a cam, then the closing element thread 46 may be regarded as a cam follower. On the other hand, if the body thread 44 is regarded as the cam follower, then the closing element thread 46 may be regarded as the cam. In either case, it is to be realized that the relative rotational movement between the closing element 28 and the body 24 could result from rotating the closing element 28 relative to the body 24 being held stationary, or could result from rotating the body 24 (along with the attached container 26) relative to the closing element 28 being held stationary, or could result from rotating both the closing element 28 and body 24 simultaneously in opposite directions.

Figure 2:
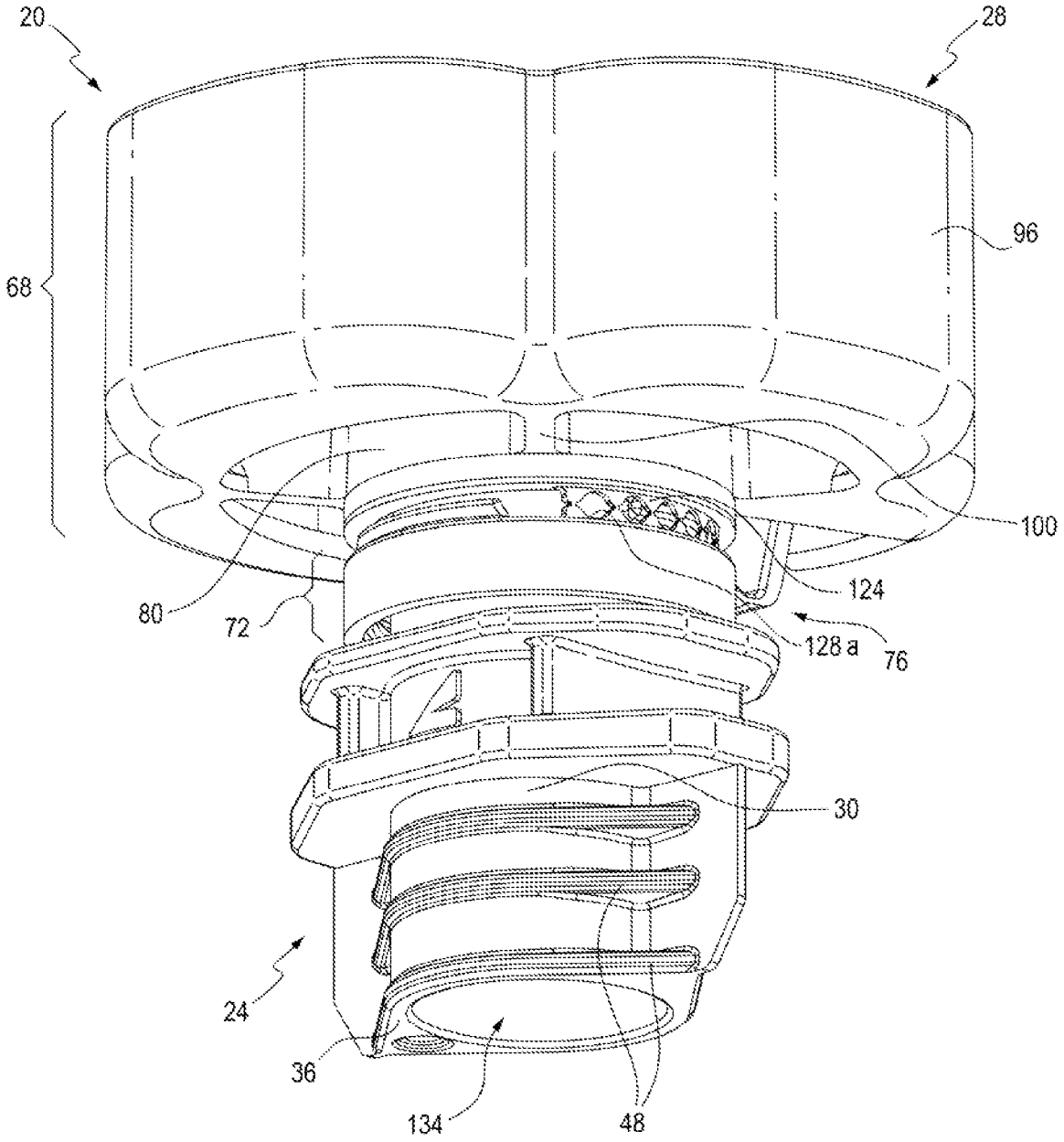
FIG. 2 is an isometric view, from the bottom front and right side, of the closure of FIG. 1.

Referring now to FIGS. 2 and 5, the base portion 30 structure is configured for being mounted to a container 26 (FIG. 26), such as a collapsible, flexible pouch or a bottle (not illustrated), or other container 26 to which the closure 20 is intended to be attached. The illustrated preferred embodiment of the closure body 24 includes a base portion 30 structure including a plurality of laterally-extending ribs 48 in the form of a fitment (e.g., a "boat-shaped," heat-sealable fitment such as disclosed in the U.S. Pat. No. RE 39,520, which is incorporated herein by reference in its entirety).

If the container 26 is a bottle, then it is presently contemplated that most bottlers would prefer to have the closure 20 provided to them with the closure body 24 base portion 30 suitably configured with a snap-fit attachment feature or threaded attachment feature for installation of the closure 20 on the bottle which would mate with the attachment configuration on the base portion 30 of the closure body 24.

Further, other means of providing a generally non-removable or removable attachment of the closure 20 to the container 26 are contemplated. These other means could include the use of a suitable mechanical lock, spin welding of the closure to the container, mechanical staking, adhesive, etc.

It is to be understood that the cross-section of the access passage 34 need not be uniform and circular as shown. The access passage 34 may be elliptical, polygonal, or some other regular or irregular shape depending on the application.

As can be seen in FIG. 4, the spout portion 32 of the body 24 includes a laterally extending annular flange 50 for cooperating with one or more annular retention beads 54 on a tamper evidence portion of the closing element 28, as will be discussed in greater detail hereinafter.

The closing element 28 has an as-molded, unactuated configuration or condition (illustrated in FIGS. 1-5) and is adapted to be installed on the body 24 in an initially assembled orientation (illustrated in FIGS. 1-5) defining an initial, fully closed condition of the closure 20. In this condition, a combination of the closing element 28 and body 24 together define an initially assembled orientation of the closure 20 which prevents, but can be subsequently operated to permit, communication of a substance through the access passage 34 of the body 24. The operation to permit passage of the substance through the body 24 is the unscrewing of an upper portion of the closing element 28 from the body 24 as described hereinafter.

Figure 3:
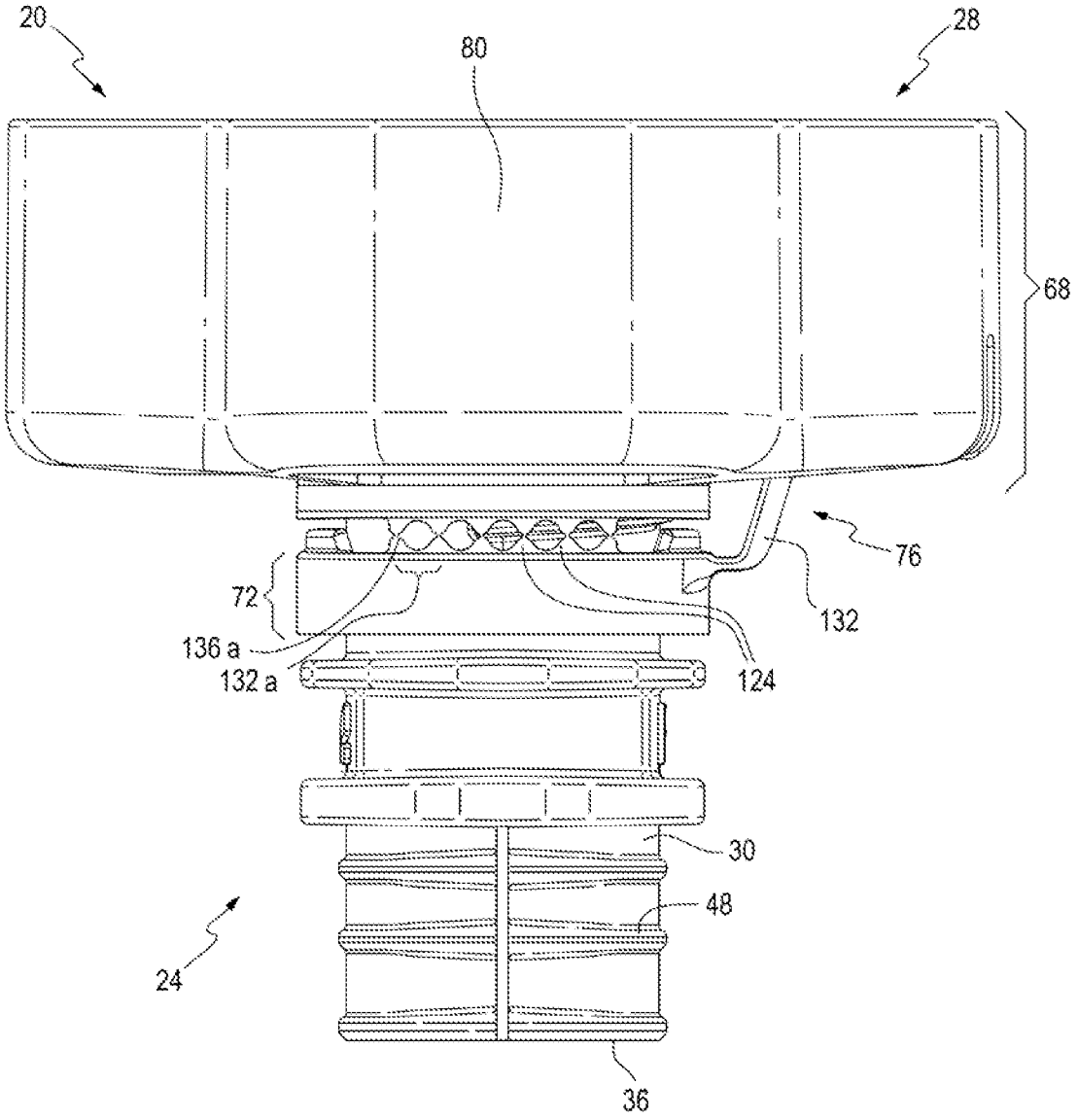
FIG. 3 is a right-side elevational view of the closure shown in FIG. 1.

With reference to FIGS. 2, 3, 4, 5 and 8, the closing element 28 includes a movable first portion 68 and a second portion 72 that is to remain attached or retained on the body 24. The first portion 68 and second portion 72 are initially connected together at two locations: (i) at frangible elements extending between the bottom of the first portion 68 and the top of the second portion 72, and (ii) at the peripheries of the first portion 68 and the second portion 72 by a tether or connecting element 76 (FIG. 5). As will be discussed in greater detail below, the inventors have discovered that the unique, shielded arrangement of the connecting element 76 within the first portion 68 in the as-molded, unactuated configuration of the closing element 28 (as illustrated in FIGS. 3-5), minimizes or at least reduces, the likelihood of damage to a major portion or majority 78 (FIG. 4) of the length of the connecting element 76 during installation of the closing element 76 on the body 24, during shipping or handling of the closure 20, and during manufacture of a package containing the closure 20. The length of the connecting element 76 is understood as the total straightened length of the connecting element 76 from is connection with the first portion 68 to its connection with the second portion 72, moving along the geometric center of the connecting element 76.

With reference to FIGS. 4 and 5, the grippable portion or first portion 68 of the closing element 24 includes a generally cylindrical sleeve or inner wall 80 having an open end 84 for receiving the spout portion 32 of the body 24 and a transverse wall or closed end 88 for occluding the access passage 34 of the body 24. The inner wall 80 includes the aforementioned closing element thread 46 for engaging the aforementioned body thread 44 to effectuate the controlled relative axial and rotational movement between the closing element 28 and the body 24. A plug seal 92 extends axially downwardly from the inside of the closing element closed end 88 and is generally cylindrical in the illustrated preferred first embodiment of the closure 20, but which is preferably slightly tapered (at least on the exterior) so as to sealingly engage an internal edge portion of the spout portion 32.

Still referring to FIGS. 4 and 5, the first portion 68 of the closing element 24 includes an outer wall 96 that substantially, fully surrounds the inner wall 80. The outer wall 96 is connected to the inner wall 80 by one or more bridges 100, such as the four bridges 100 as illustrated. While the bridges 100 are generally planar, radially extending structures, they may have other shapes, and there may be more or fewer bridges, such as a single transverse wall extending between the inner wall 80 and the outer wall 96. The outer wall 96 extends, relative to a central longitudinal axis 104 defined by the closing element 28, axially outwardly of the closed end 88 of the inner wall 80. Preferably, the bridges 100 have a sloping, concave upper surface 108 that slopes downwardly from the outer wall 96 to the inner wall 80. In the preferred illustrated first embodiment of the closure 20, the closing element 28 includes four symmetrically spaced bridges 100 connecting the inner wall 80 and the outer wall 96. Each adjacent pair of bridges 100 defines therebetween a protected zone or space 112. One of the spaces 112 accommodates and shields a majority of the length of the connecting element 76 in the unactuated configuration of the closing element 28, as discussed hereinafter.

Figure 1:
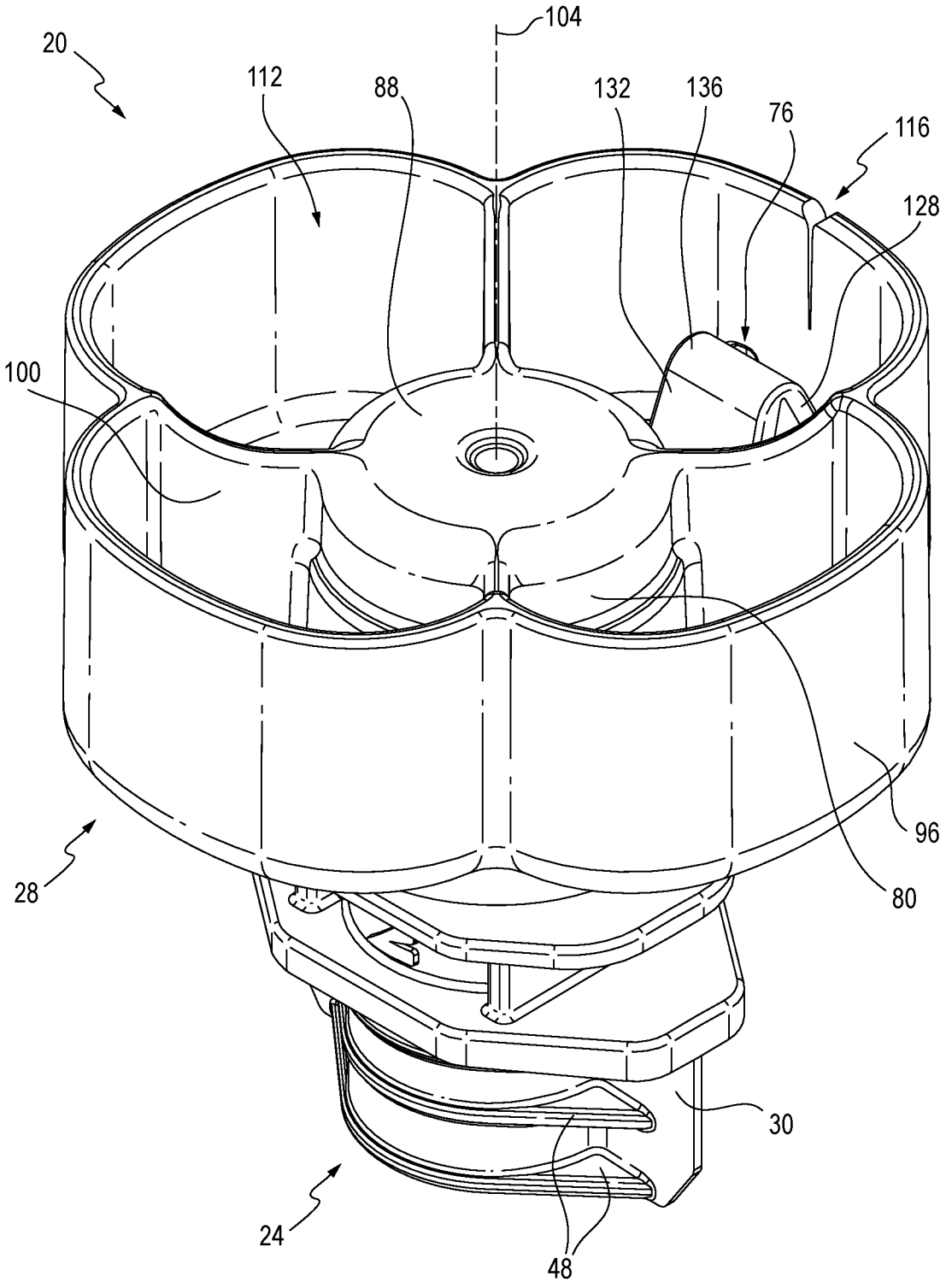
FIG. 1 is an isometric view, from the top front and right side, of a first embodiment of a closing element of the present invention in an as-molded, unactuated configuration assembled with a body in the form of a fitment so that the assembly can be installed as a closure at the opening of a flexible pouch type of container (not shown in FIG. 1)

With reference to FIG. 1, it can be seen that the outer wall 96 has a clover-like shape with four arcuate petals or portions extending in a perimeter between adjacent pairs of bridges 100. The outer wall 96 is adapted to be engaged by a user's fingers and thumb to assist in rotating the closing element 28 relative to the body 24. The outer wall 96 is preferably dimensioned to meet standard child choke proof protocols. Specifically, the diameter of the outer wall 96 in the radial direction relative to the axis 104 is preferably sized greater than the width of a child's airway. In the preferred first embodiment illustrated, the spaces 112 provide an airway through the closing element 28 to prevent choking and to further minimize the amount of material required for forming the closing element 28 to reduce the weight of the overall closure 20. A clip or notch 116 is located in the top end (axially outward end) of the outer wall 96 which functions to secure the first portion 68 of the closing element 28 to a portion of the container 26 when the closure 20 is manipulated by a user to a fully opened condition (as shown in FIGS. 21-27).

Figure 21:
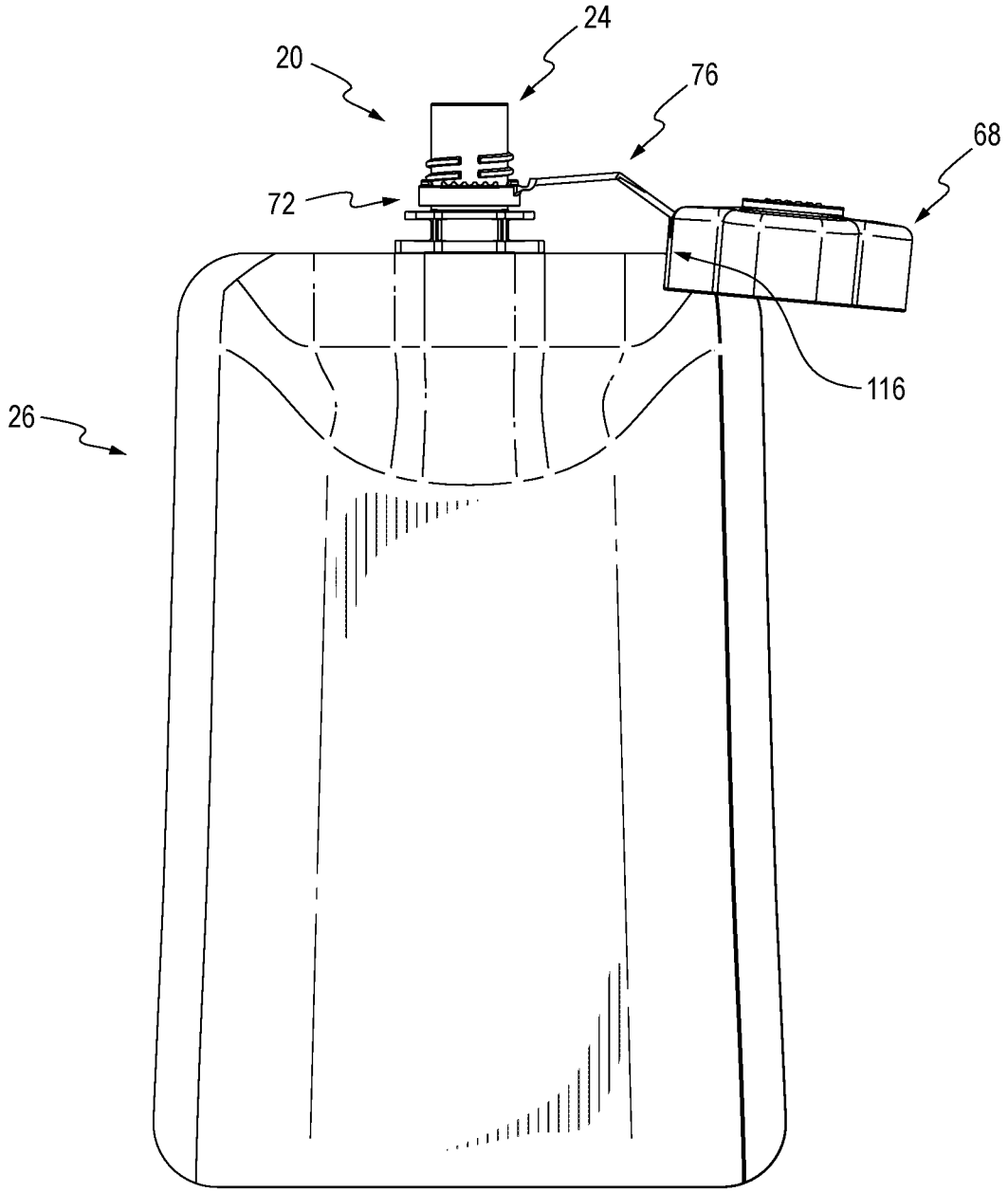
FIG. 21 is front elevation view of the closing element and body in the form of a closure of FIG. 1 with the body of the closure installed at the opening of a container in the form of a flexible pouch—the closure, pouch, and contents therein defining a package.
Figure 22:
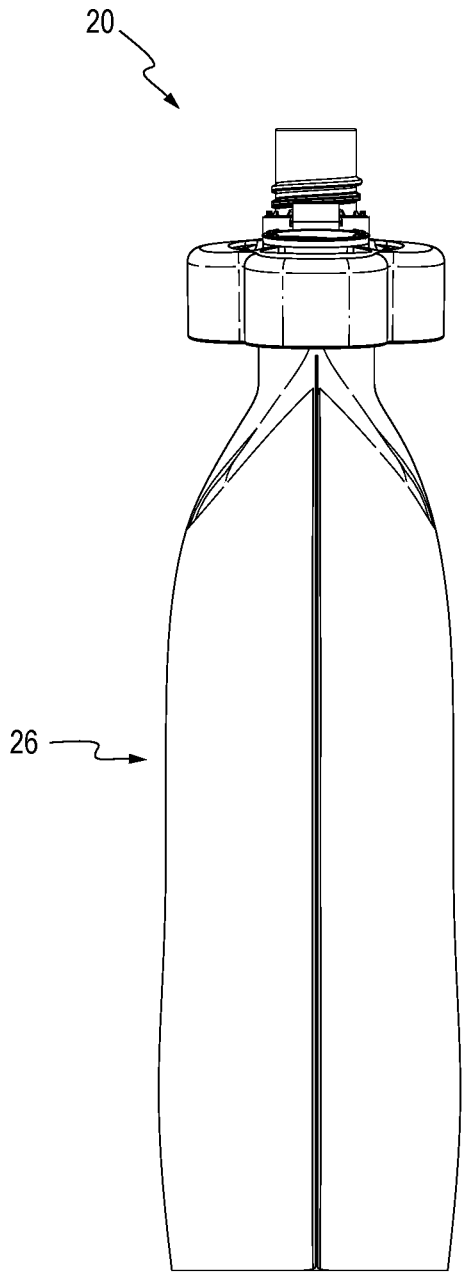
FIG. 22 is a right-side elevational view of the package of FIG. 21.
Figure 23:
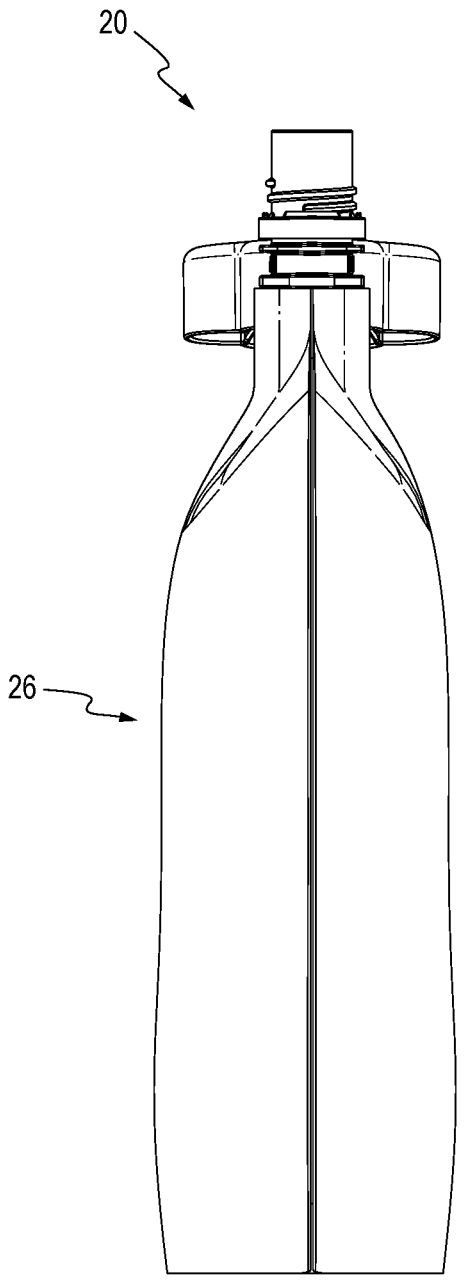
FIG. 23 is a left-side elevational view of the package of FIG. 21.
Figure 24:
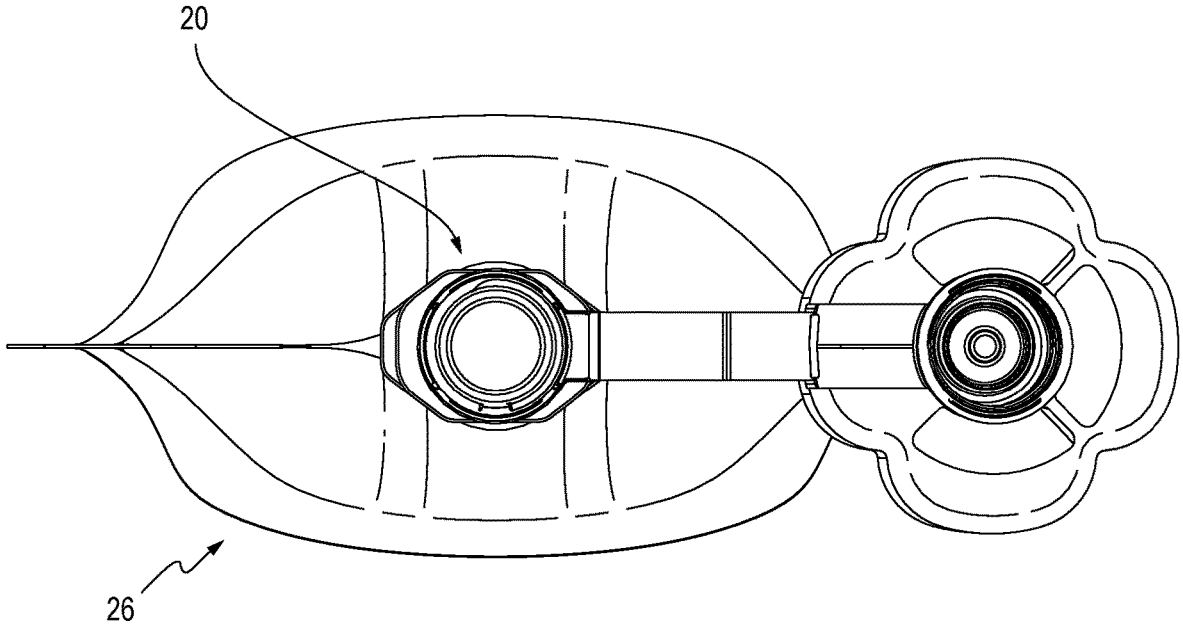
FIG. 24 is a top plan view of the package of FIG. 21.
Figure 25:
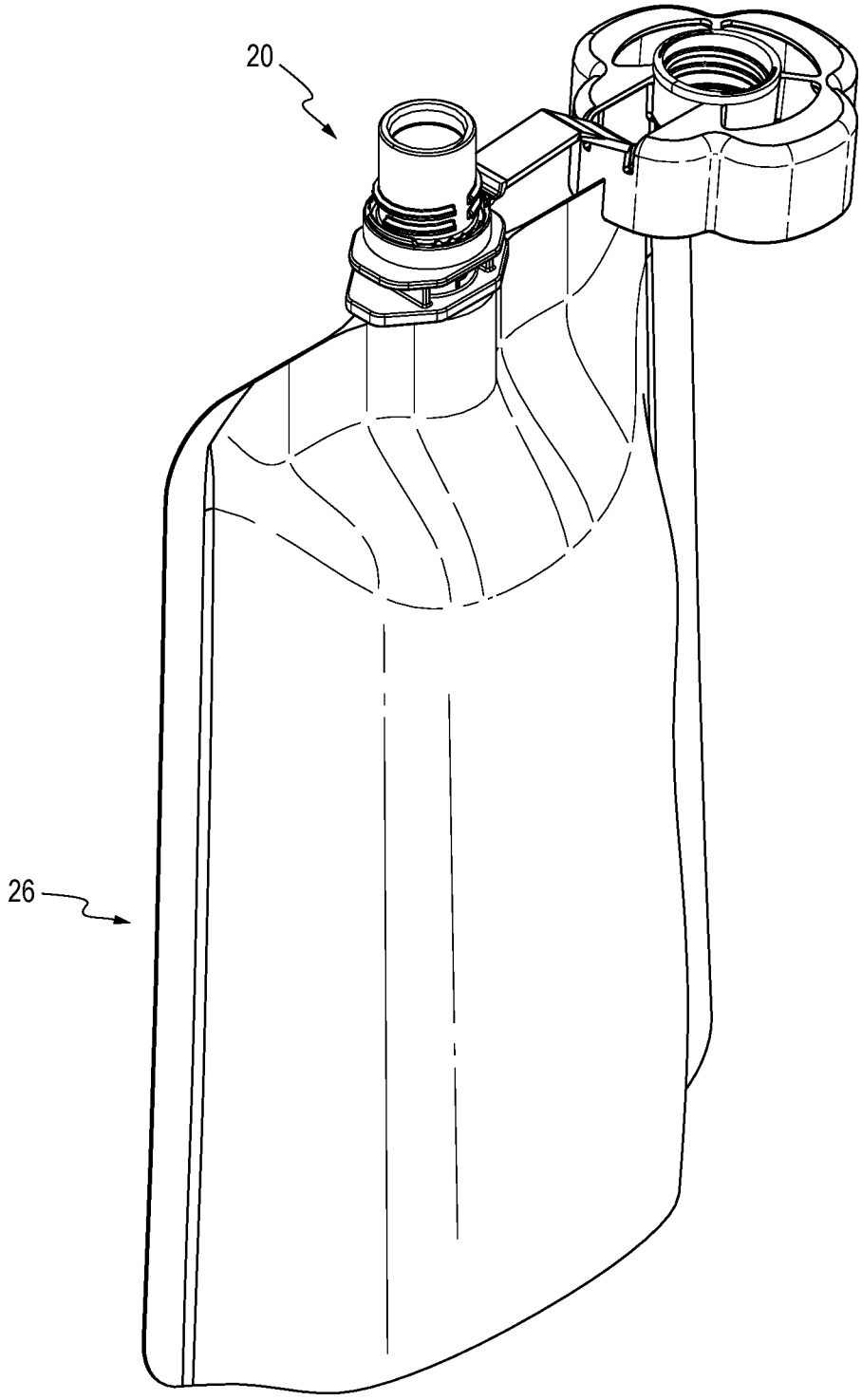
FIG. 25 is an isometric view, from the top front and left side, of the package of FIG. 21.
Figure 26:
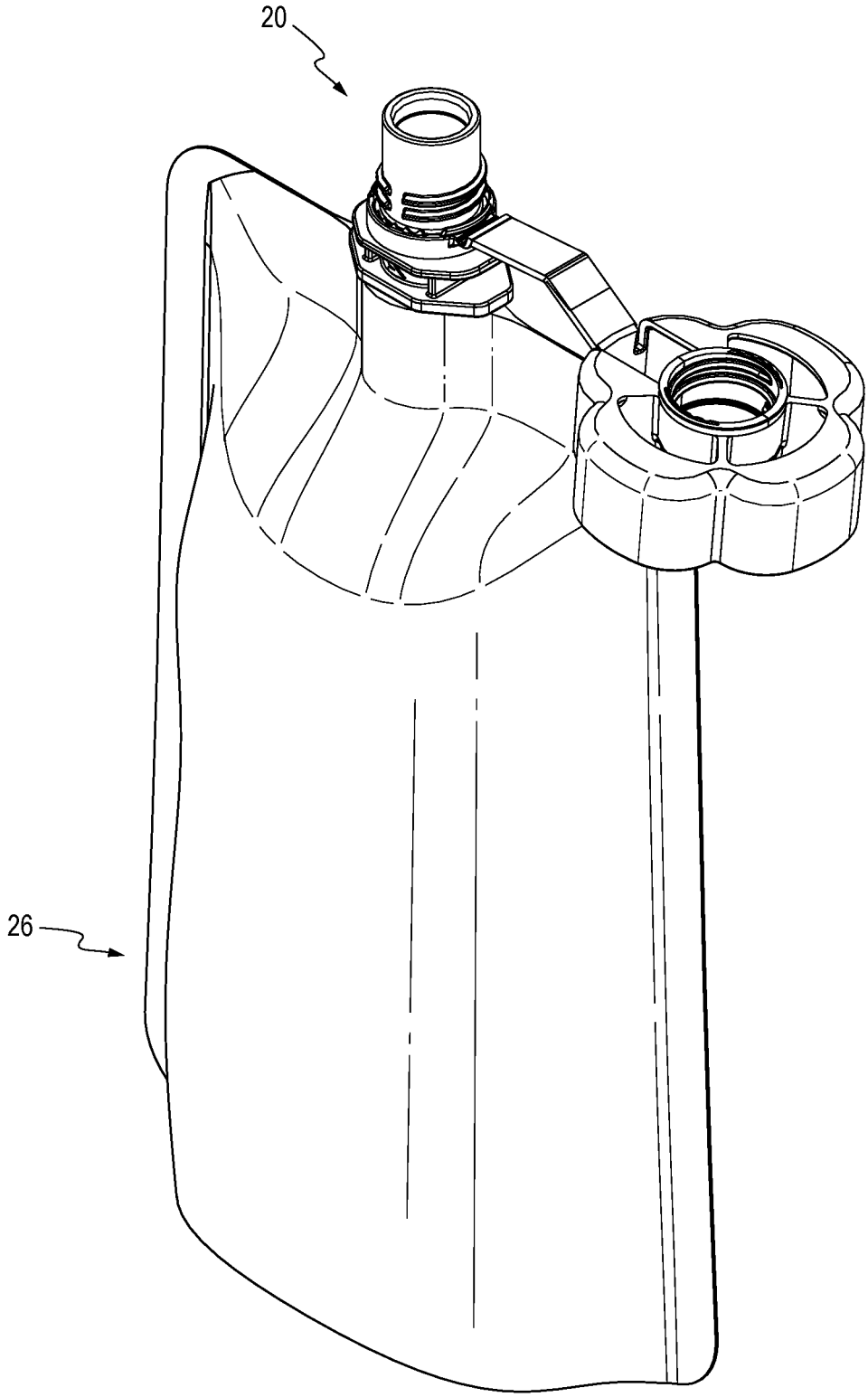
FIG. 26 is an isometric view, from the top front and right side, of the package of FIG. 21.
Figure 27:
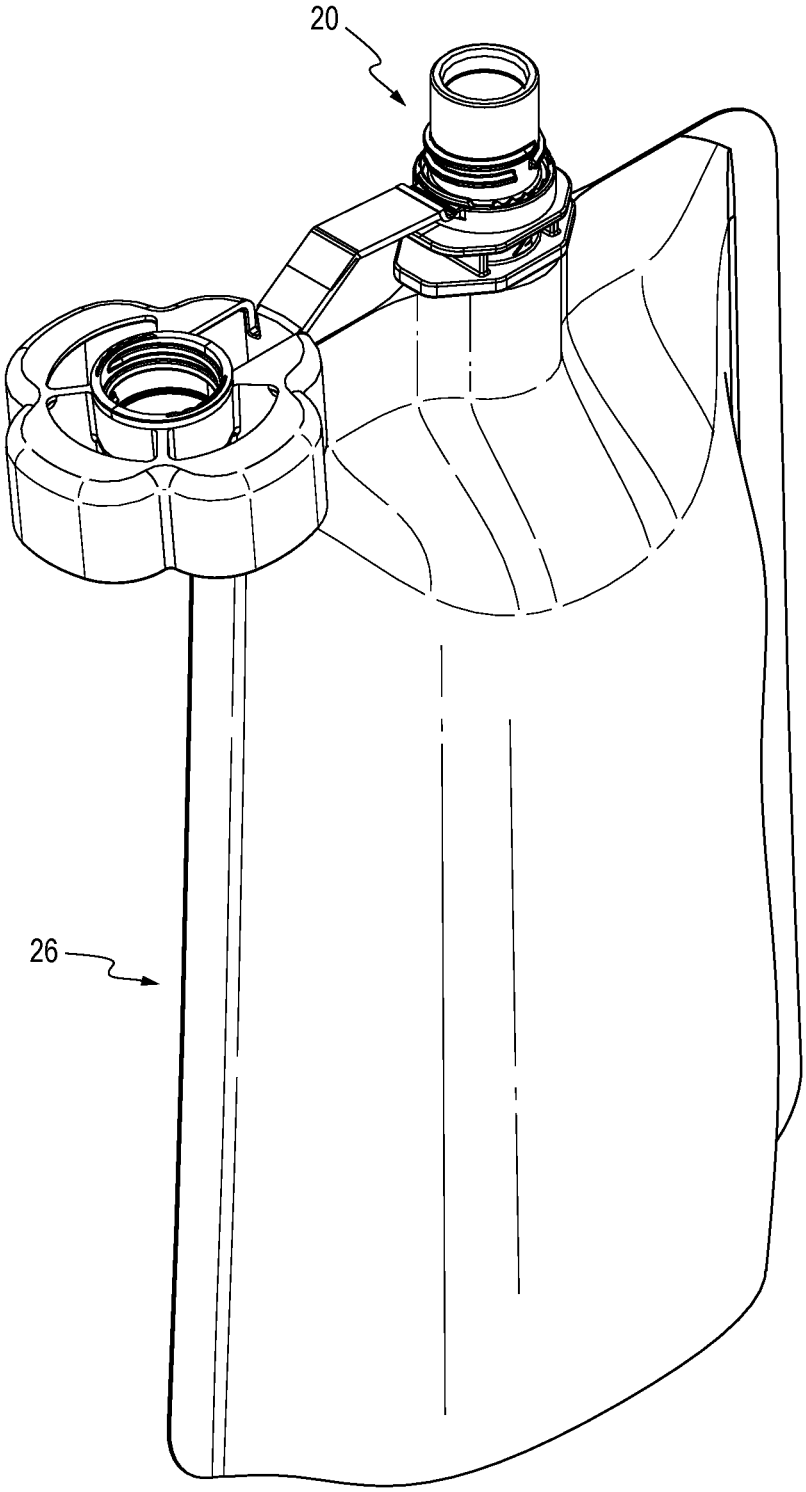
FIG. 27 is an isometric view, from the top rear and right side, of the package of FIG. 21.
Figure 28A:
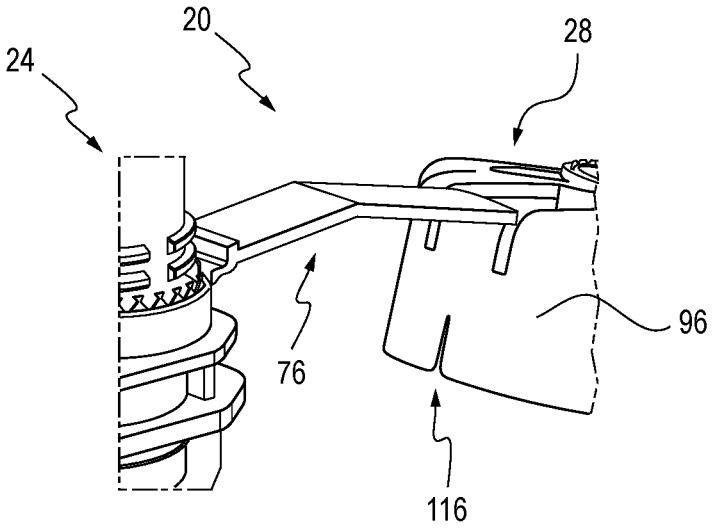
FIG. 28A is a fragmentary, isometric view from above, of a notch in the outer wall of the closing element and the closure body of FIG. 1.
Figure 28B:
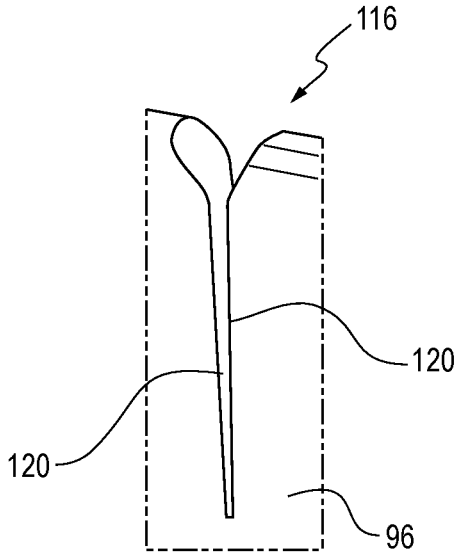
FIG. 28B is a greatly enlarged, fragmentary isometric view from below, of the notch in the outer wall of the closing element of FIG. 28A.

With reference to FIG. 28B, the notch 116 includes a pair of opposing, tapering surfaces 120 for frictionally receiving or gripping a portion of the container 26, such as a sealed edge portion of a pouch type container, as illustrated in FIG. 21. With reference to FIG. 1, the notch 116 is located proximate to (axially above) the connecting element 76 with the closing element 28 in its as-molded, unactuated configuration.

Figure 16:
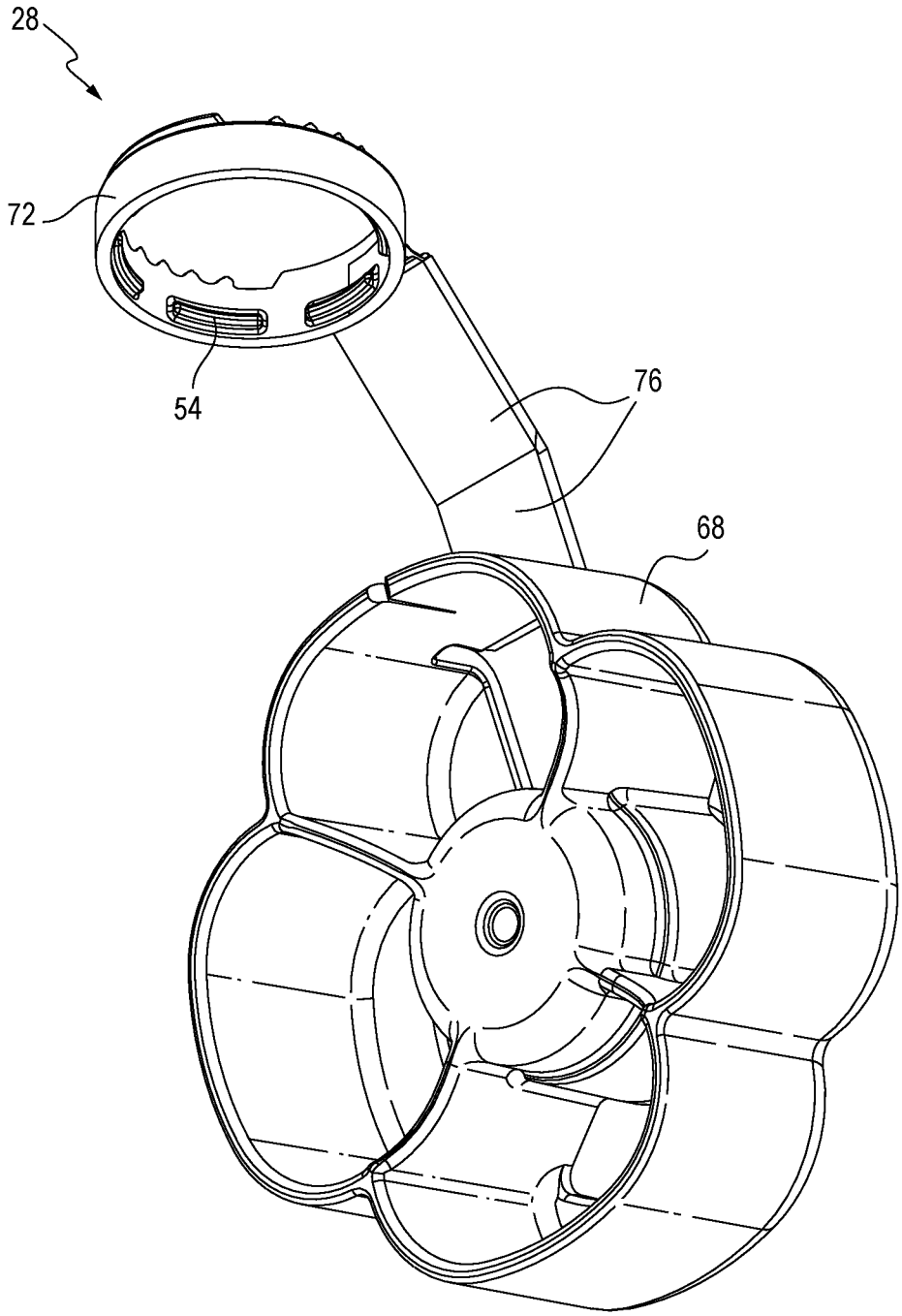
FIG. 16 is an isometric view, from the bottom front and right side, of the closing element of FIG. 14.
Figure 17:
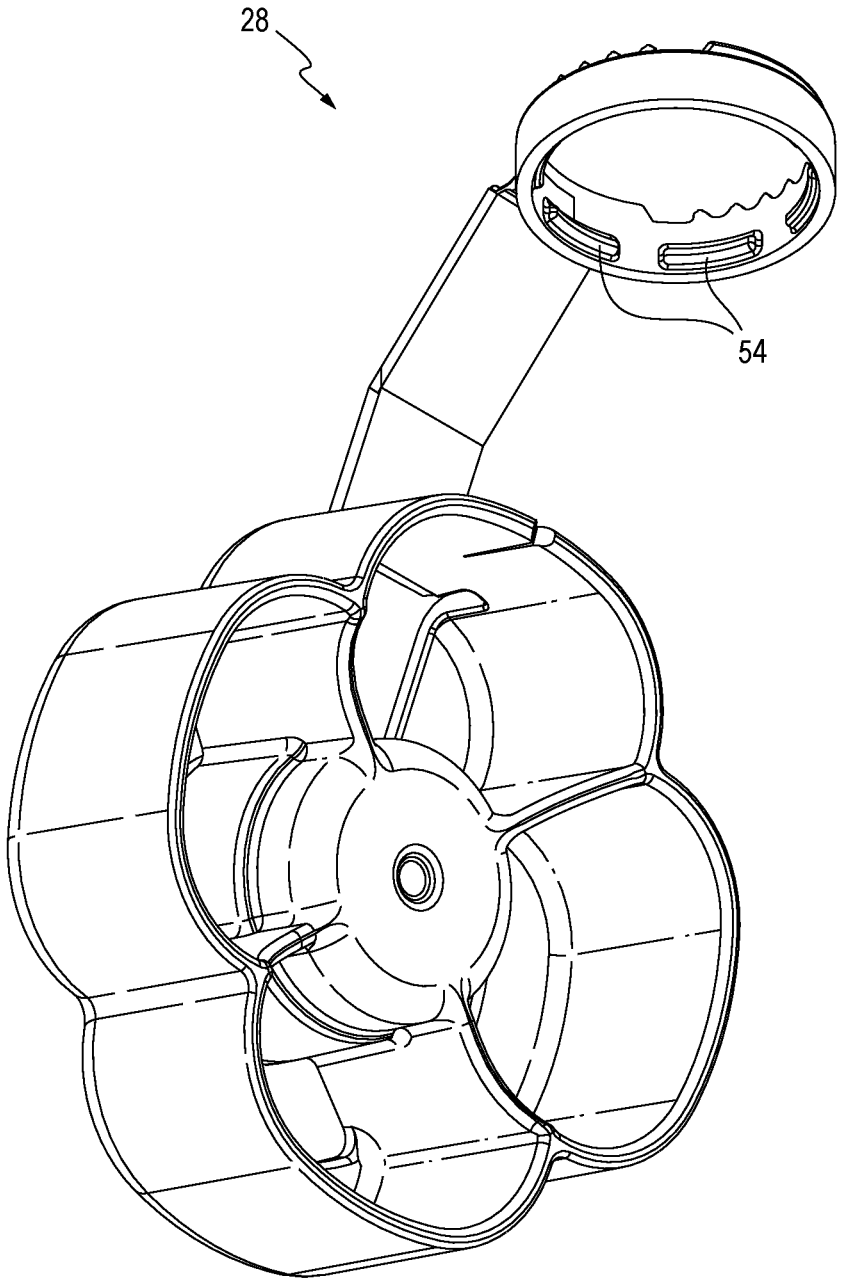
FIG. 17 is an isometric view, from the bottom front and left side, of the closing element of FIG. 14.

With reference to FIGS. 4 and 16, the second portion 72 of the closing element 28 has a ringlike shape that includes the aforementioned radially extending annular retention beads 54 for cooperating with the annular flange 50 of the body 24 (FIG. 4) to non-removably secure the second portion 72 around the spout portion 32 (FIG. 4) of the body 24.

As can be seen in FIG. 3, a plurality of tamper evident, or frangible elements 124 extend circumferentially between the second portion 72 and the inner wall 80 of the first portion 68. Adjacent frangible elements 124 define a lemon shaped aperture 128*a* therebetween, wherein the aperture 128*a* has a circular central portion 132*a* with a pair of opposite, tapered ends 136*a*. The frangible elements 124 are configured to break under tension when the closing element 28 is rotated a predetermined amount relative to the body 24.

Figure 18:
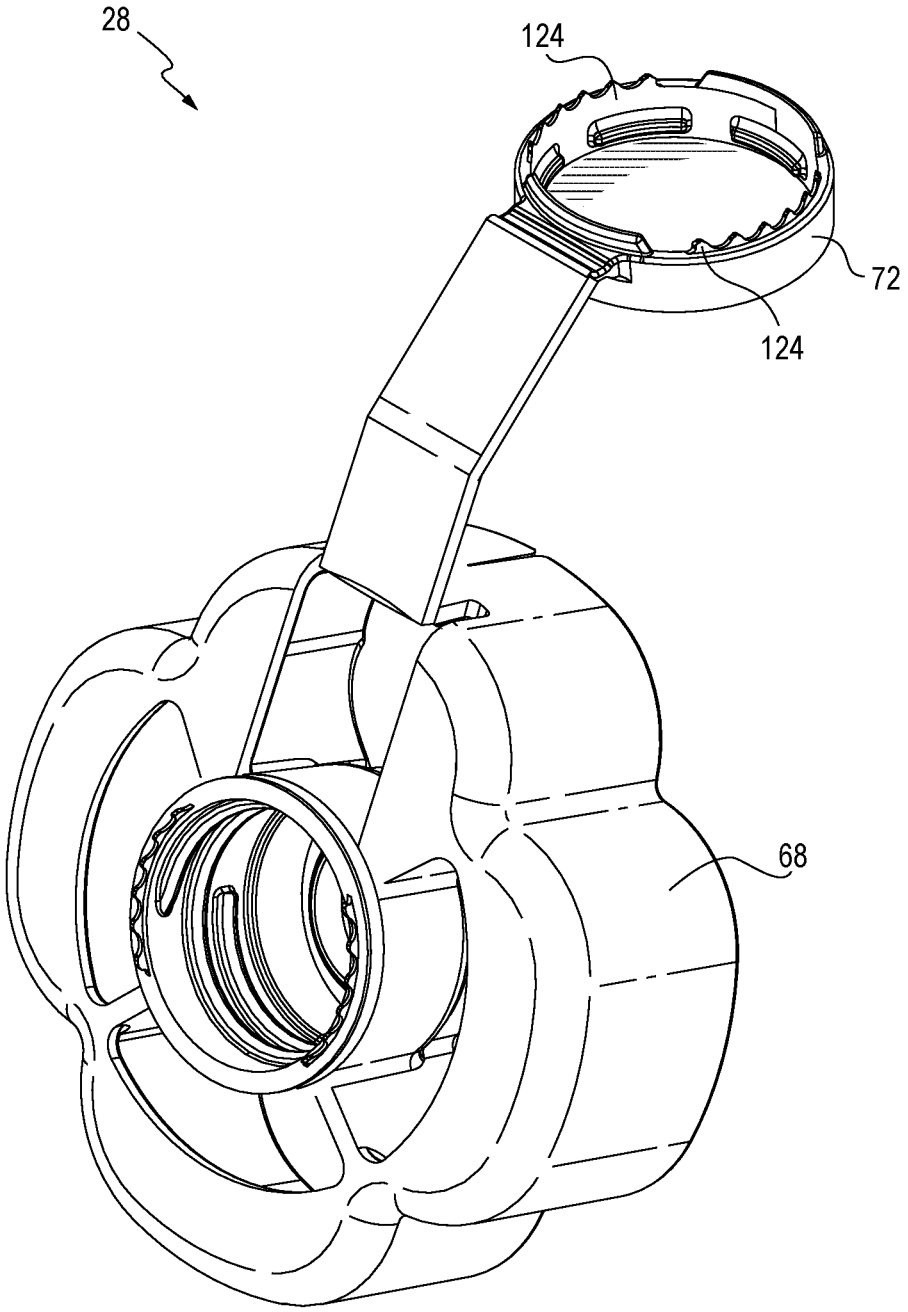
FIG. 18 is an isometric view, from the top rear and left side, of the closing element of FIG. 14.
Figure 19:
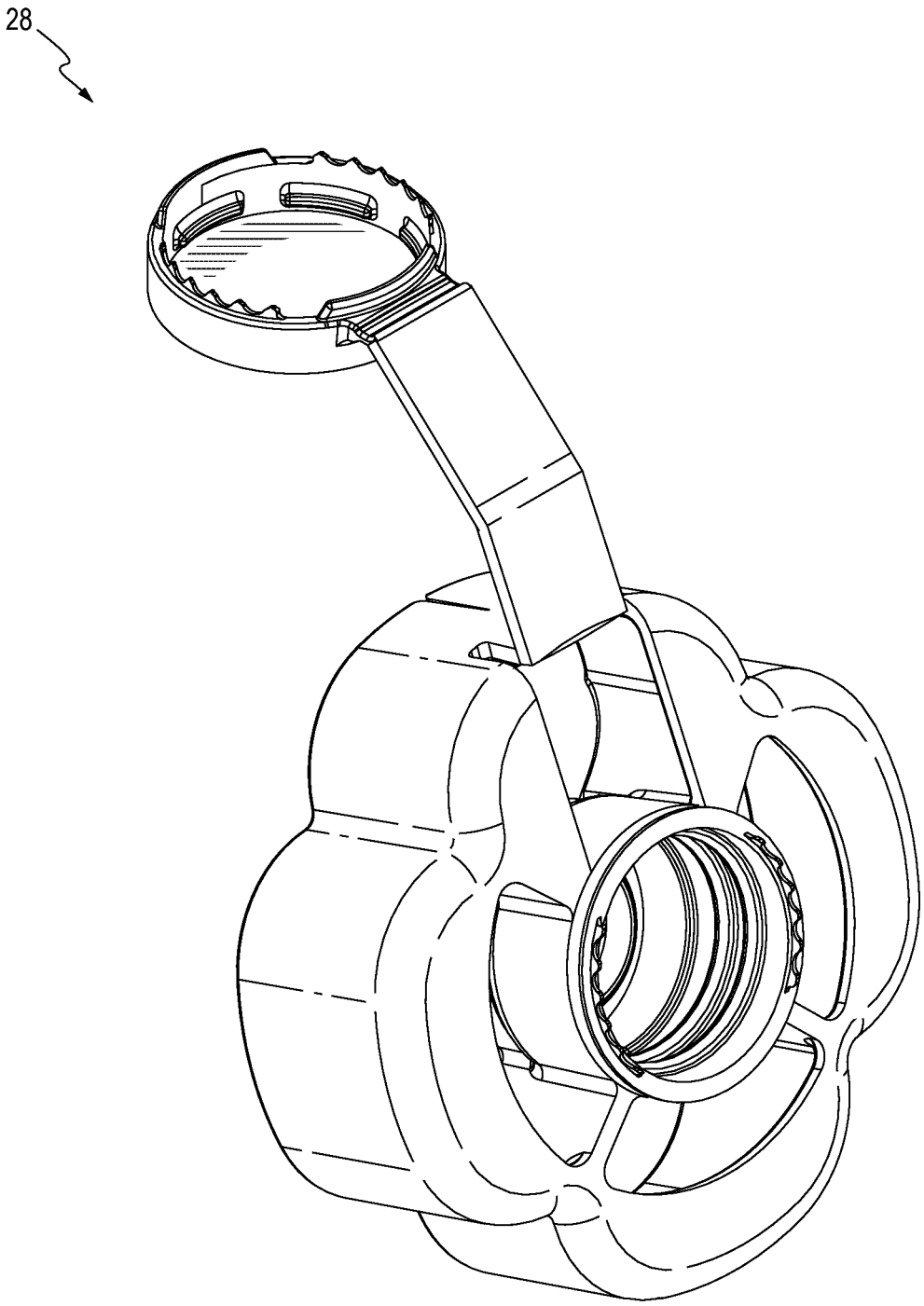
FIG. 19 is an isometric view, from the top rear and right side, of the closing element of FIG. 14.
Figure 20:
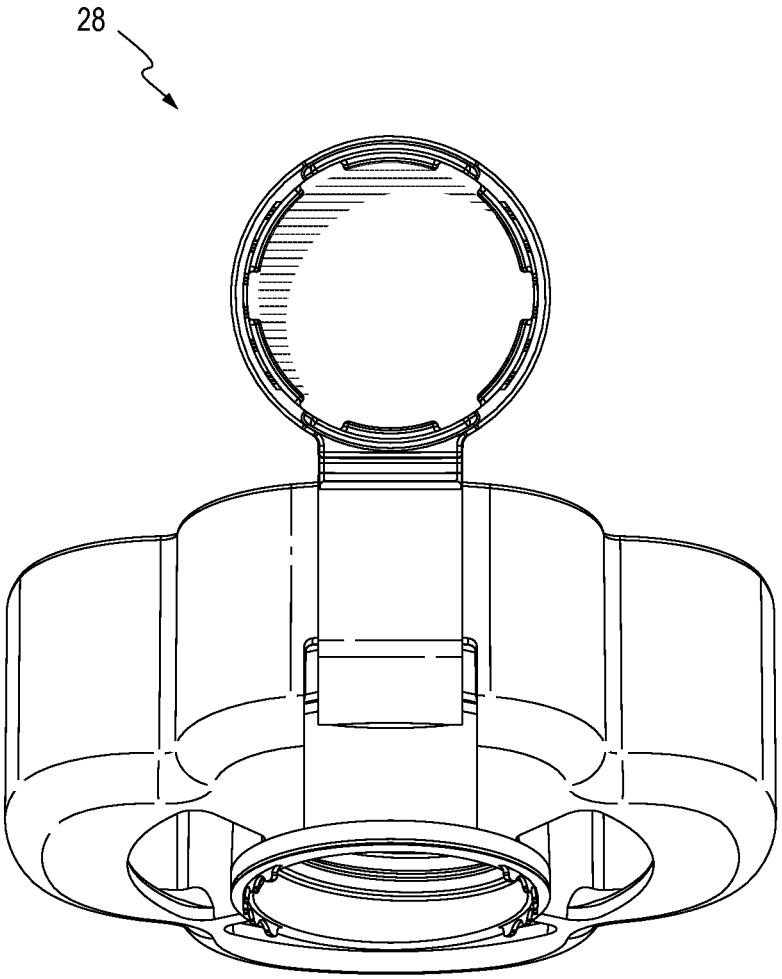
FIG. 20 is a top plan view, rotated 180 degrees, of the closing element of FIG. 14.

In the preferred first illustrated embodiment, the closing element 28 defines, between the second portion 72 and the inner wall 80 of the first portion 68, two sets of a plurality of frangible elements 124 located about 180° apart on both sides of the connecting element 76 (visible in FIG. 18).

With reference to FIG. 3, each frangible element 124 has a somewhat chalice-shaped structure with a narrow, axially extending, straight center portion between curved, flaring top and bottom end portions. The inventors have found that this shape provides an improved indication of tamper evidence, compared to prior art closures, whereby the broken remnants of adjacent frangible elements 124 on the first portion 68 and second portion 72 have an unaligned or offset configuration (FIGS. 6 and 7) when the closing element first portion 68 is reinstalled or closed on the body 24 after initial opening and use of the closure 20, as discussed below.

Figure 9:
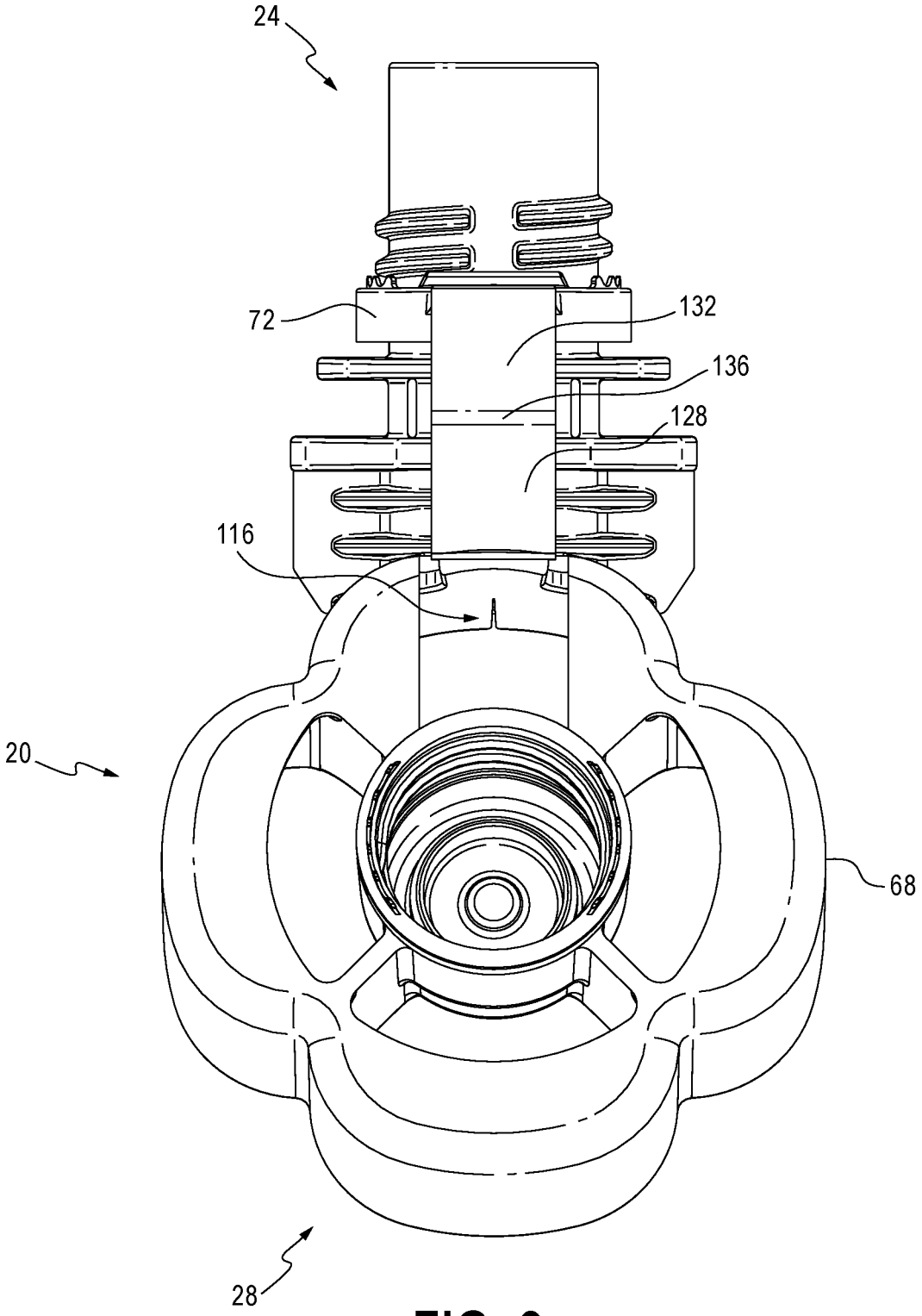
FIG. 9 is a rear elevational view of the opened closure shown in FIG. 8.
Figure 10:
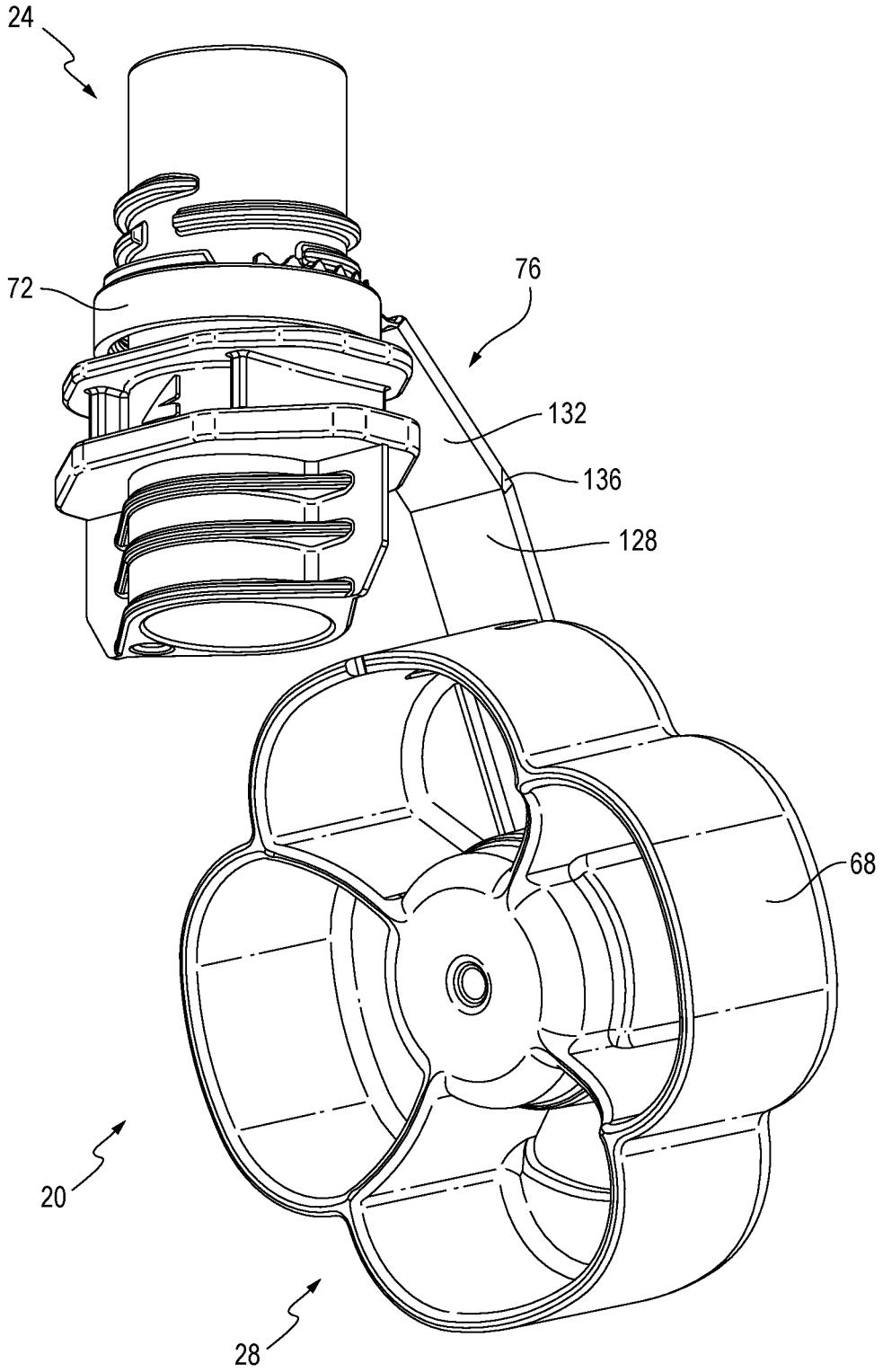
FIG. 10 is an isometric view, from the bottom front and right side, of the opened closure of FIG. 8.
Figure 11:
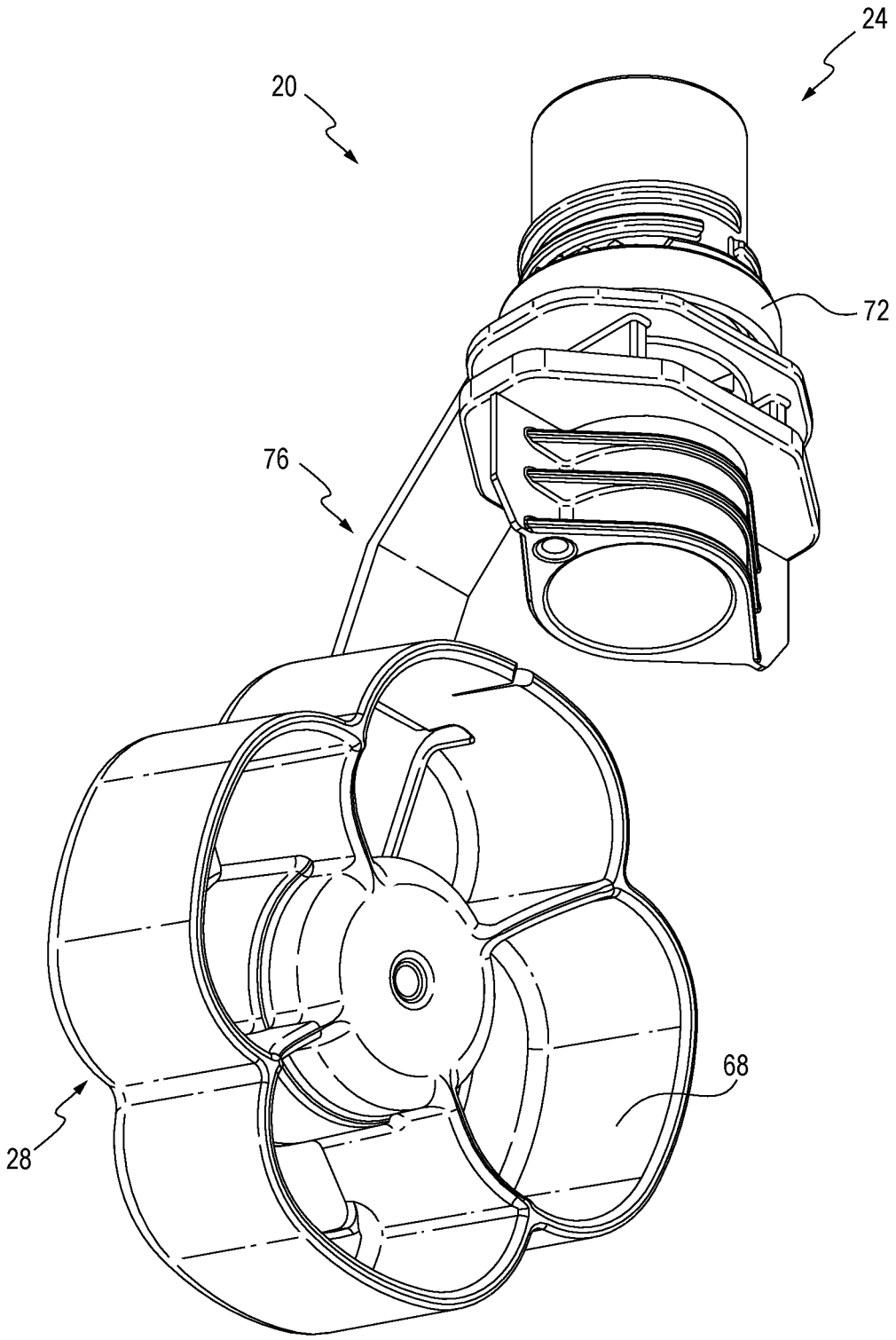
FIG. 11 is an isometric view, from the bottom front and left side, of the opened closure of FIG. 8.
Figure 12:
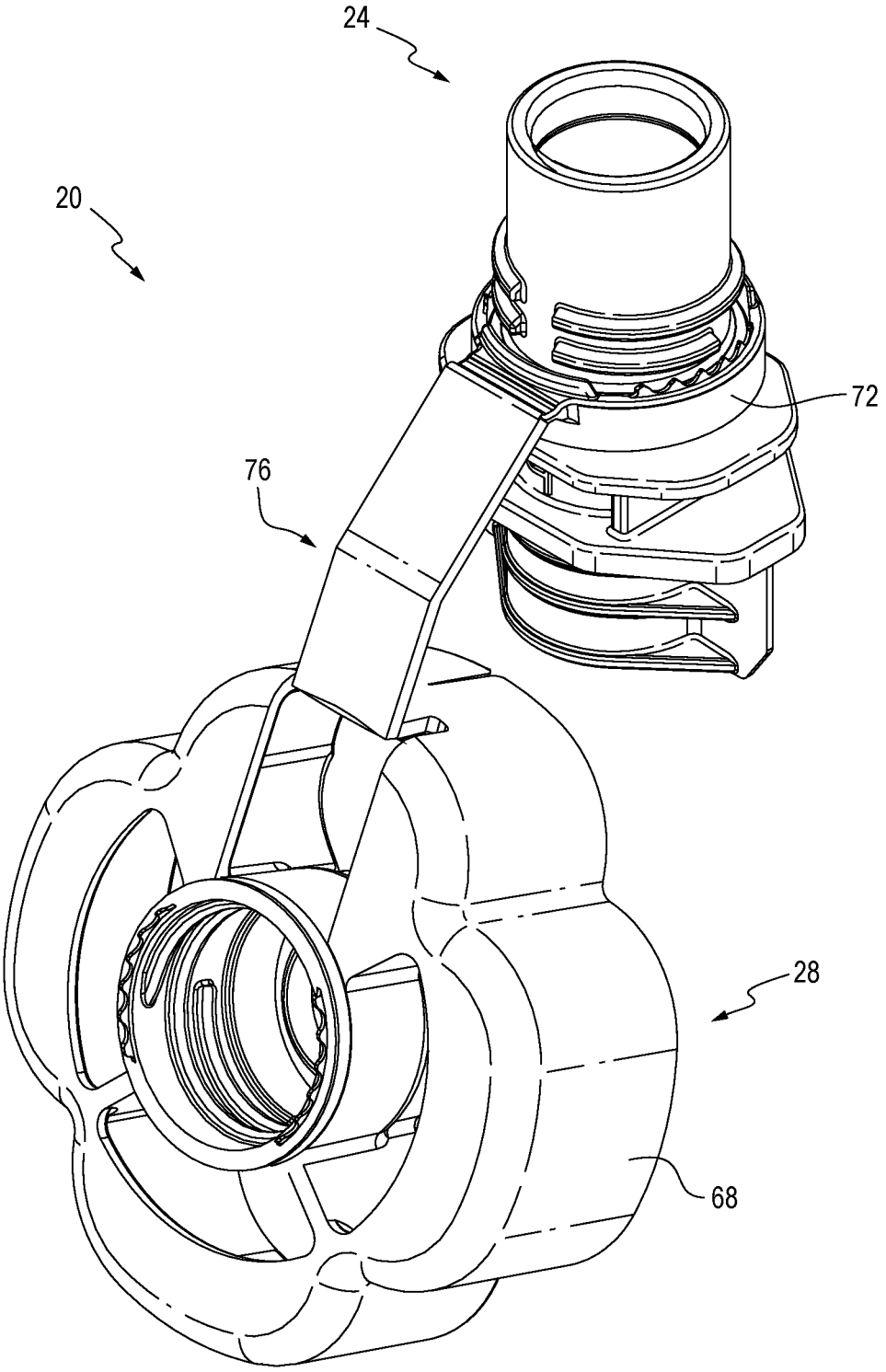
FIG. 12 is an isometric view, from the top rear and left side, of the opened closure of FIG. 8.
Figure 13:
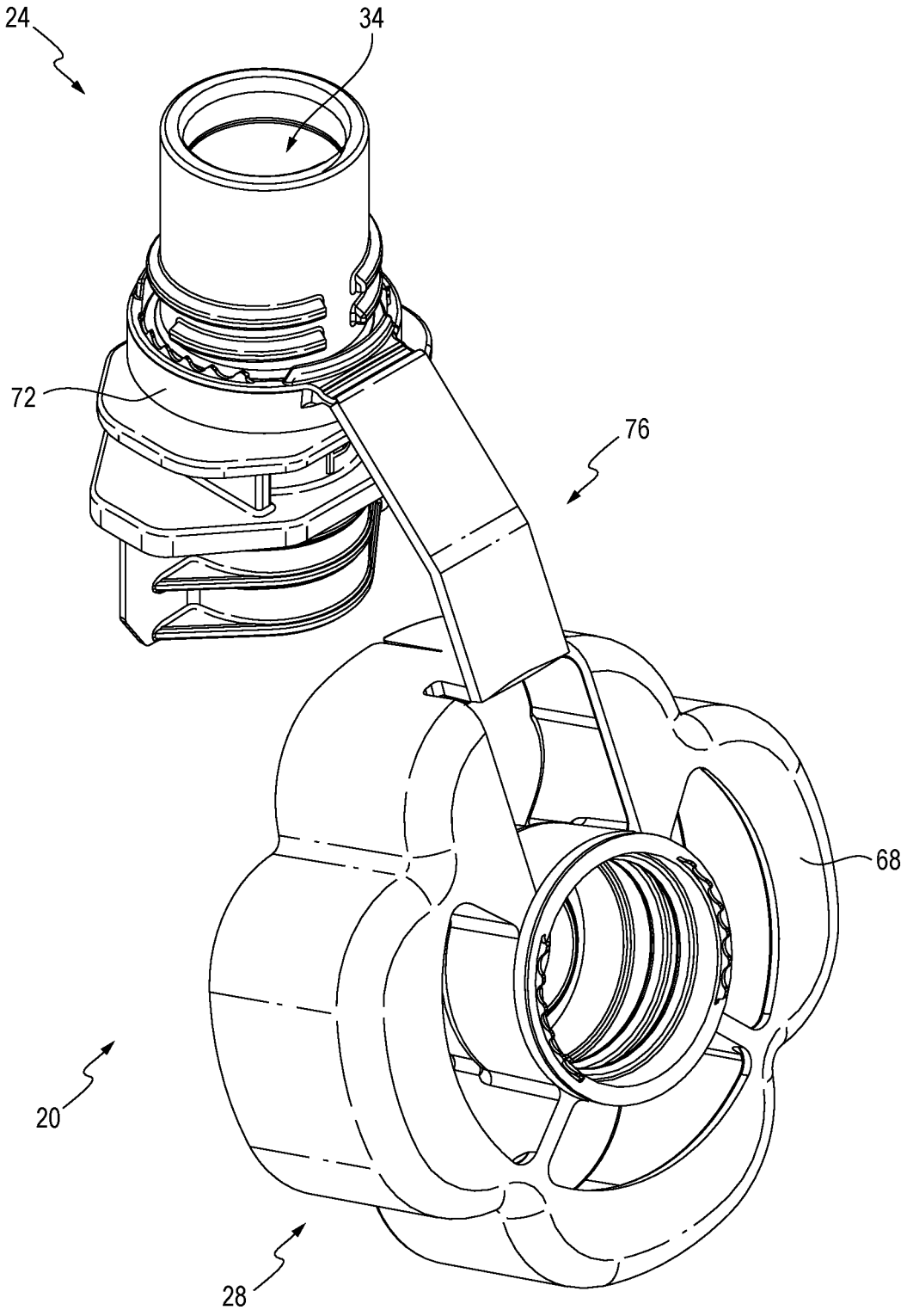
FIG. 13 is an isometric view, from the top rear and right side, of the opened closure of FIG. 8.
Figure 14:
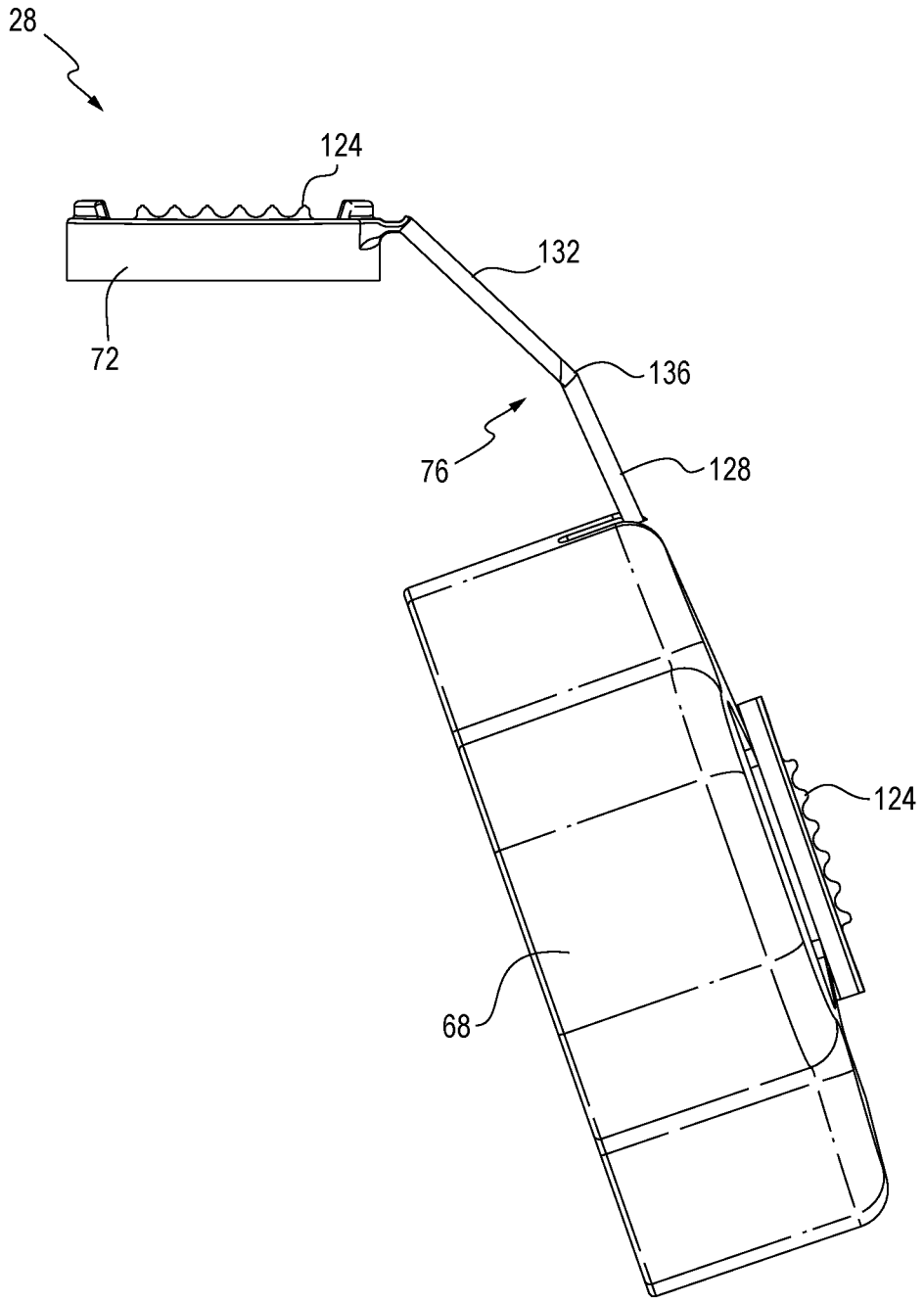
FIG. 14 is a right-side elevational view of only the closing element of the closure shown in FIG. 1.
Figure 15:
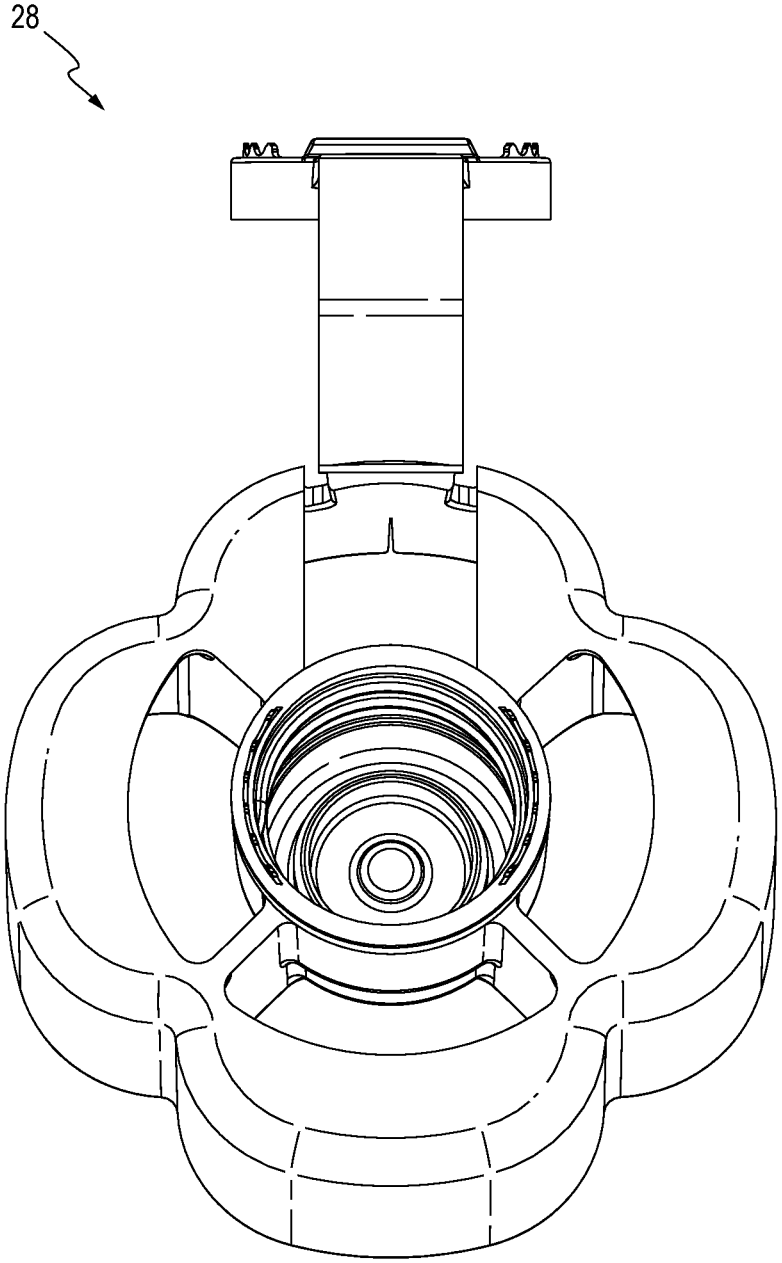
FIG. 15 is a rear elevational view of the closing element shown in FIG. 14.

With reference now to FIGS. 4 and 5, the connecting element 76 has the form of an elongate strap or tether with a first leg 128 connected to the rear, bottom of the outer wall 96 of the first portion 68, a second leg 132 connected to the rear, top of the second portion 72 of the closing element 28, and a hinge 136 joining or extending between the first and second legs 128, 132. As can be seen in FIG. 9, a pair of slots 140 are defined on either side of the connecting element 76, between the first leg 128 and the outer wall 96 of the closing element 28. In the as-molded, unactuated configuration of the closing element 28, the first leg 128 and second leg 132 extend in an inverted V-shape, axially outwardly such that the hinge 136 is located laterally or radially in-between the inner wall 80 and the outer wall 96. In addition, in the as-molded, unactuated configuration of the closing element 28, the hinge 136 is located axially outwardly, above, the second portion 72 of the closing element 28. Furthermore, in this position, the hinge 136 is located inwardly, beneath, the closed end 88 of the inner wall 80. Additionally, a major portion of the length of the connecting element 76 is laterally shielded between the inner wall 80 and the outer wall 96.

The inventors have found that the arrangement of the connecting element 76 of the closing element 28 provides a robust protection against damage to the connecting element 76 during shipping, handling, and during the assembly of the closure components by preventing the connecting element 76 from being caught or impacted during relative rotation of the closing element 28 and the body 24. In addition, the inventors have found that the closure 20 having the connecting element 76 as described, facilitates the unobstructed access to the access passage 34 of the body 24 when the closure 20 is moved into its fully open condition with the first portion 68 of the closing element 28 either affixed to the container 26 (FIGS. 21-27) or positioned near or against a surface of the container 26 (FIGS. 29A-29D).

Initially, the body 24 and the closing element 28, in its as-molded, unactuated configuration, are preferably separately molded or otherwise provided as separate components. Subsequently, in a preferred process, the manufacturer assembles the two components together by effecting relative axial movement between the two components of the closure 20 so as to force the spout portion 32 of the body 24 into the open end 84 of the inner wall 80 of the closing element 28. Continued axial movement of the components of the closure 20 causes the annular retention beads 54 on the closing element 28 to be forced radially outwardly over, and then slip radially inwardly beneath, the annular flange 50 on the body 24 to create a snap-fit securement of the second portion 72 of the closing element 28 to the body 24. This creates an attachment that a user would regard as making the second portion 72 non-removable from the body 24. In this initially assembled orientation (FIGS. 1-5), the plug seal 92 of the closing element 28 extends downwardly form an annular seal against the inside surface of the access passage 34 of the body 24. The assembly process may be effected without relative rotation between the closing element 28 and body 24. Alternatively, the two components could be threaded together and screwed into the initially assembled orientation.

After the assembly of the body 24 and closing element 28 in the initially assembled orientation (which is the initial, fully closed condition of the closure 20), the body thread 44 is engaged with the closing element thread 46 in a manner that would effect upward axial movement of the first portion 68 of the closing element 28 during an initial amount of an opening or unthreading relative rotation between the body 24 and closing element 28.

An unthreading rotation of the closing element 28 away from fully closed condition of the closure 20 shown in FIGS. 1-5, while maintaining the position of the body 24, will cause the frangible elements 124 between the first portion 68 and second portion 72 to break under tension, as the second portion 72 is axially constrained by its engagement with the flange 50 of the body 24, and the first portion 68 of the closing element 28 is free to move axially outwardly along the body thread 44. As the relative rotation is effected between the closing element 28 and the body 24, typically by a user grasping and rotating the closing element 28 in the counterclockwise direction, the frangible elements 124 sequentially break due to the axial load overcoming the design limit of the narrow, middle portions of the frangible elements 124. The material(s) of the body 24 and the second portion 72 are selected so that the coefficients of friction of the body 24 and the second portion 72 permit the second portion 72 to rotate with the first portion 68 to prevent distortion or damage to the connecting element 76 during unthreading rotation of the closing element 28.

As the frangible elements 124 are broken, an audible click or audible clicks may be generated to inform the user that the frangible elements 124 are being broken. The user can visually observe the severing of the frangible elements 124. Depending on the material from which the closing element 28 is molded, and depending on the particular thickness and/or shape of each frangible element 124, the sound generated by the breaking of each frangible element 124 may be more or less audible to the user. According to the broad aspects of the present invention, although the generation of a sound that is particularly audible to the user is preferred, that is not a necessary requirement or essential feature of the broad aspects of the invention.

As the frangible elements 124 are broken, whether or not a sound is heard by the user, the breaking of each frangible element 124 may also provide a slight tactile feedback so that a relatively rapid rotation of the closing element 28 through a first angle of rotation can result in a vibratory feeling or feedback that is sensed by the user who is opening the closure 20. According to the broad aspects of the invention, such discernible tactile feedback, while preferred, is not a required or essential feature of the broad aspects of the invention. It will also be appreciated that when the frangible elements 124 are broken, the closing element 28 still remains a unitary structure without any appreciable separate tear-off pieces or debris being generated by the opening process. As a result, there are no small, separate bits of the closing element 28 that could be a choking hazard for children or that would have to be separately recovered and retained for disposal. However, the structural and operational features of the preferred embodiment of the closure 20, which prevent the formation of smaller, separate, discrete waste pieces, are not essential requirements of the broad aspects of the invention.

Figure 6:
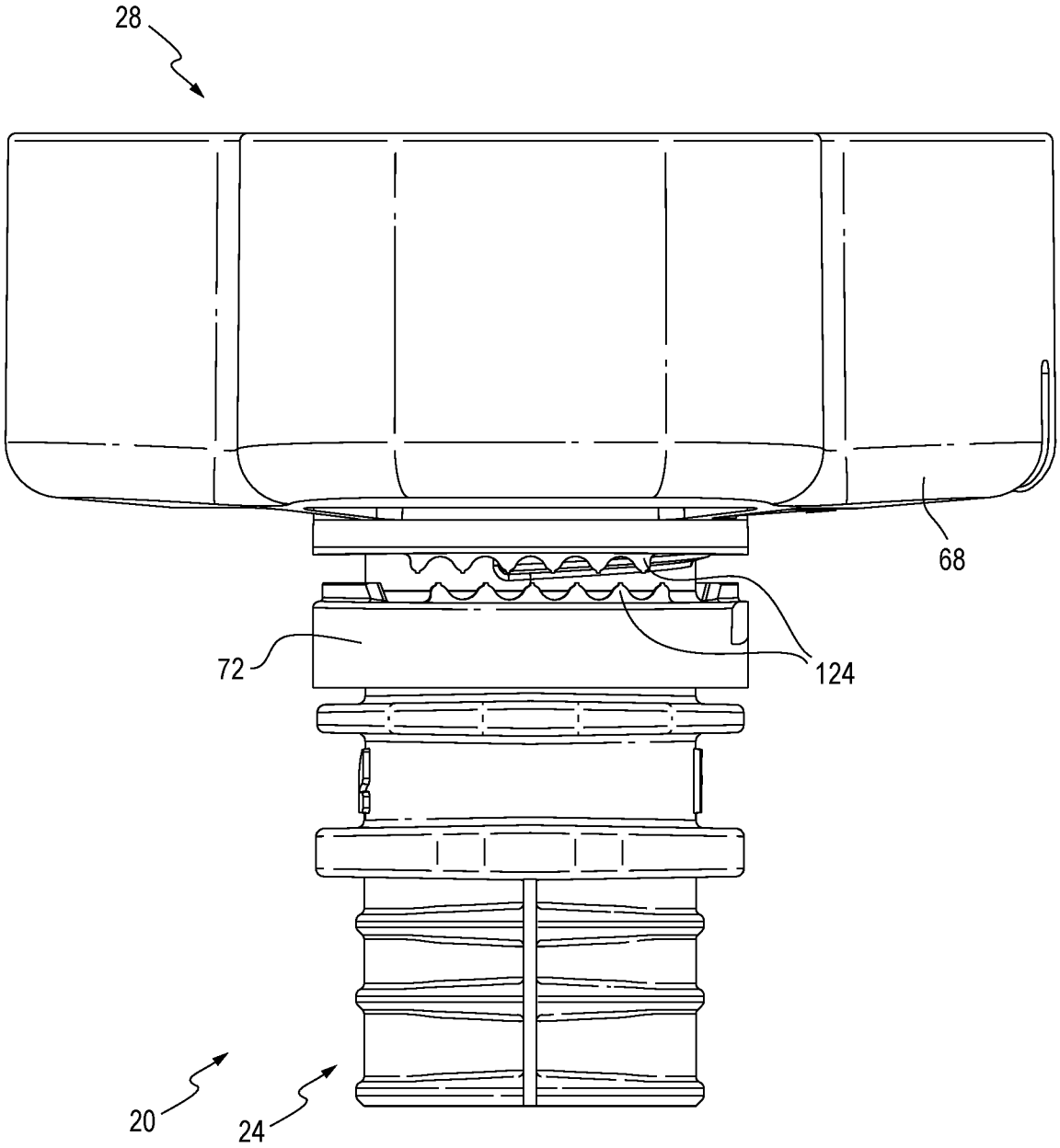
FIG. 6 is a right-side elevational view of the closure shown in FIG. 1.
Figure 7:
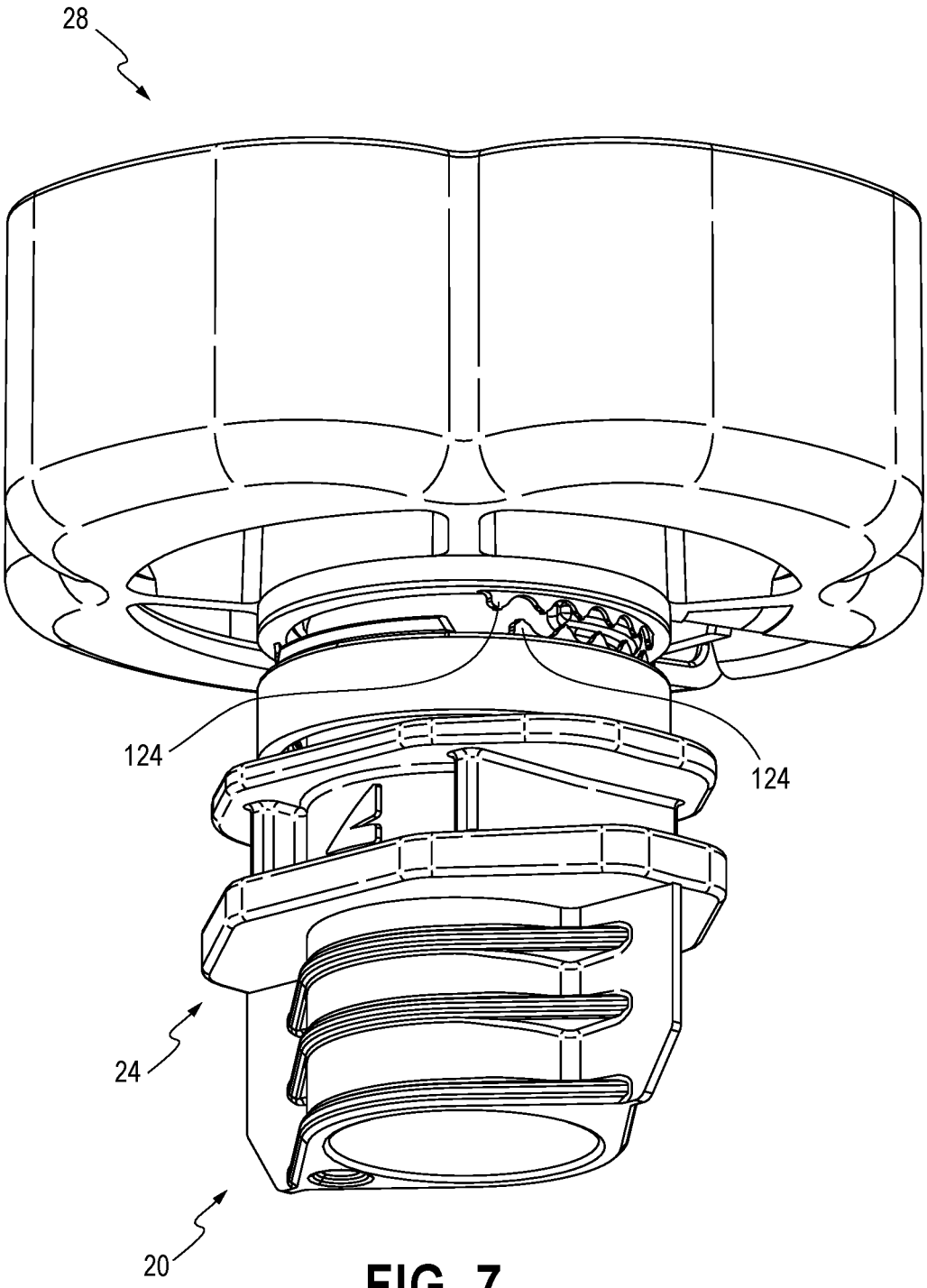
FIG. 7 is an isometric view, from the bottom front and right side, of the closure of FIG. 6.
Figure 8:
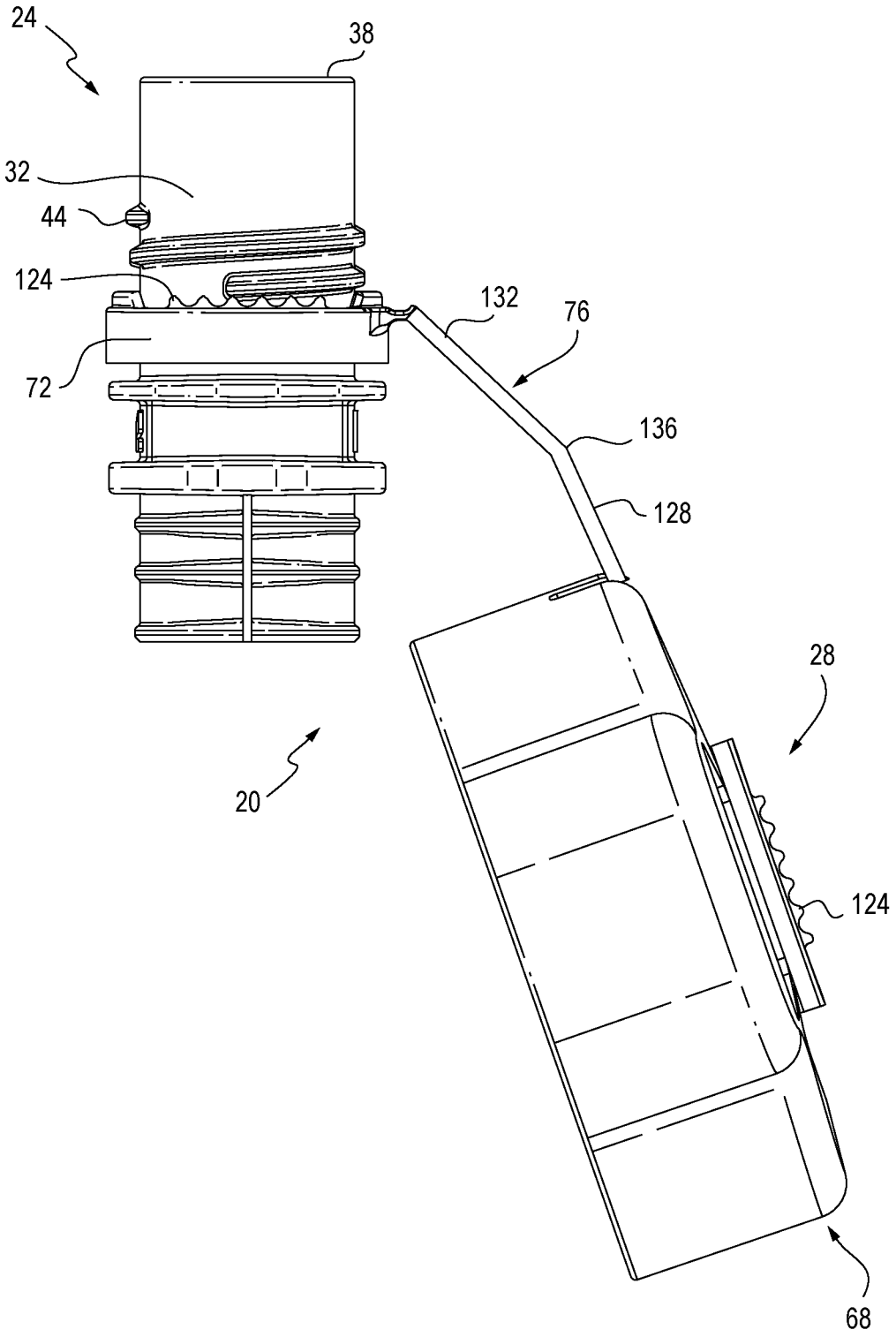
FIG. 8 is a right-side elevational view of the closure shown in FIG. 1.

As the first portion 68 of the closing element 28 is rotated and translated axially away from the body 24 by the user, the plug seal 92 first portion 68 is withdrawn from its sealing contact within the body 24 to fully expose the access passage 34 of spout portion 32 of the body 24. The user of the closure 20 may then pull the first portion 68 of the closing element 28 away from the body 24 to unfold and somewhat straighten the connecting element 76 to permit the first portion 68 of the closing element 28 to pivot and invert under the influence of gravity. The closure 20 can have a variety of fully open conditions, depending on the placement of the first portion 68 of the closing element 28 by the user. The closing element 28 may also have a variety of actuated configurations. For example, FIGS. 6 and 7 illustrate an actuated configuration of the closing element 28 where the frangible elements 124 have been visibly broken and the first portion 68 of the closing element 28 is still in position to occlude the access passage 34 of the body 24. Accordingly, in this configuration, the closure 20 is in a "closed" condition. As a further example, FIGS. 8-13 and 14-20 illustrate additional actuated configurations of the closing element 28 where the frangible elements 124 have been visibly broken and the first portion 68 of the closing element 28 is inverted and rotated away from the access passage 34 of the body 24 to an "open" condition. It will be understood that other actuated configurations are possible.

One presently preferred fully open condition of the closure 20 is illustrated in FIGS. 21-27, wherein the first portion 68 of the closing element 28 is conveniently retained or stored on a portion of the container 26. If the container 26 is a flexible pouch, then a welded or sealed edge portion of the pouch is received between the opposing surfaces 120 of the notch 116. The friction fit of the portion of the container 26 is sufficient to hold the first portion 68 of the closing element 28 while a user tips and/or inverts the package containing the closure 20 to dispense (i.e., drink, pour, remove, etc.) the contents of the package through the unobstructed access passage 34 of the body 24. If the container 26 is a rigid bottle (not illustrated), then a rigid plastic projection may be received within the notch 116. It will be understood that such mating structures may be reversed, such that the notch 116 is provided on the container 26 or the body 24, and the projection may be provided on the closing element first portion 68.

Another fully open condition of the closure 20 is illustrated in FIGS. 29A-29D, wherein the first portion 68 of the closing element 28 is resting against a portion of the container 26. If the container 26 is a flexible pouch, then the outer wall 96 of the closing element first portion 68 may rest against the generally flat front or rear surface of the pouch (as illustrated). The connecting element 76 can be made with stiffness or rigidity sufficient to maintain the first portion 68 of the closing element 28 in the fully open condition while a user tips or inverts the package containing the closure 20 to dispense (i.e., drink, pour, remove, etc.) the contents of the package through the unobstructed access passage 34 of the body 24.

With reference to FIGS. 6 and 7, when the opened first portion 68 of the closing element 28 is rethreaded onto the spout portion 32 of the body 24, the broken frangible elements 124 clearly indicate prior opening or evidence of tampering to the user. The remnants of the frangible elements 124, located on the first portion 68 and second portion 72 of the closing element 28 are configured to not be aligned when the closure 20 is returned to its fully closed condition. Specifically, the remnants of the bridges 124 are located opposite the remnants of the circular central portions 132*a* of the apertures 128*a* in an offset or interlocking fashion.

It will be appreciated that the number of the frangible elements 124, and the apertures 128*a* defined between the frangible elements 124, can be varied. In the preferred embodiment illustrated in FIGS. 1-5, the frangible elements 124 are provided in two sets or groups, with each group being located on either side of the connecting element 76. However, the frangible elements 124 could be arranged in only one group or could be arranged in more than two groups. The number of frangible elements 124 could vary from one to two or more. Also, although the frangible elements 124 each have substantially the same shape in the preferred embodiment, one or more of the frangible elements 124 could have a shape that differs from the shapes of the other frangible elements 124.

The connecting element 76 reduces the number of discrete pieces of the closure 20 for improved recycling, enabling the closing element 28 to remain with the body 24 and the container 26. The closure 20 design further enables the possibility of mono material package recyclability. For example, the closure body 24, the closing element 28, and the container 26 may be formed from the same polymer or family of polymers falling within a single recycling identification number, such a polyethylene or polypropylene.

Figure 4A:
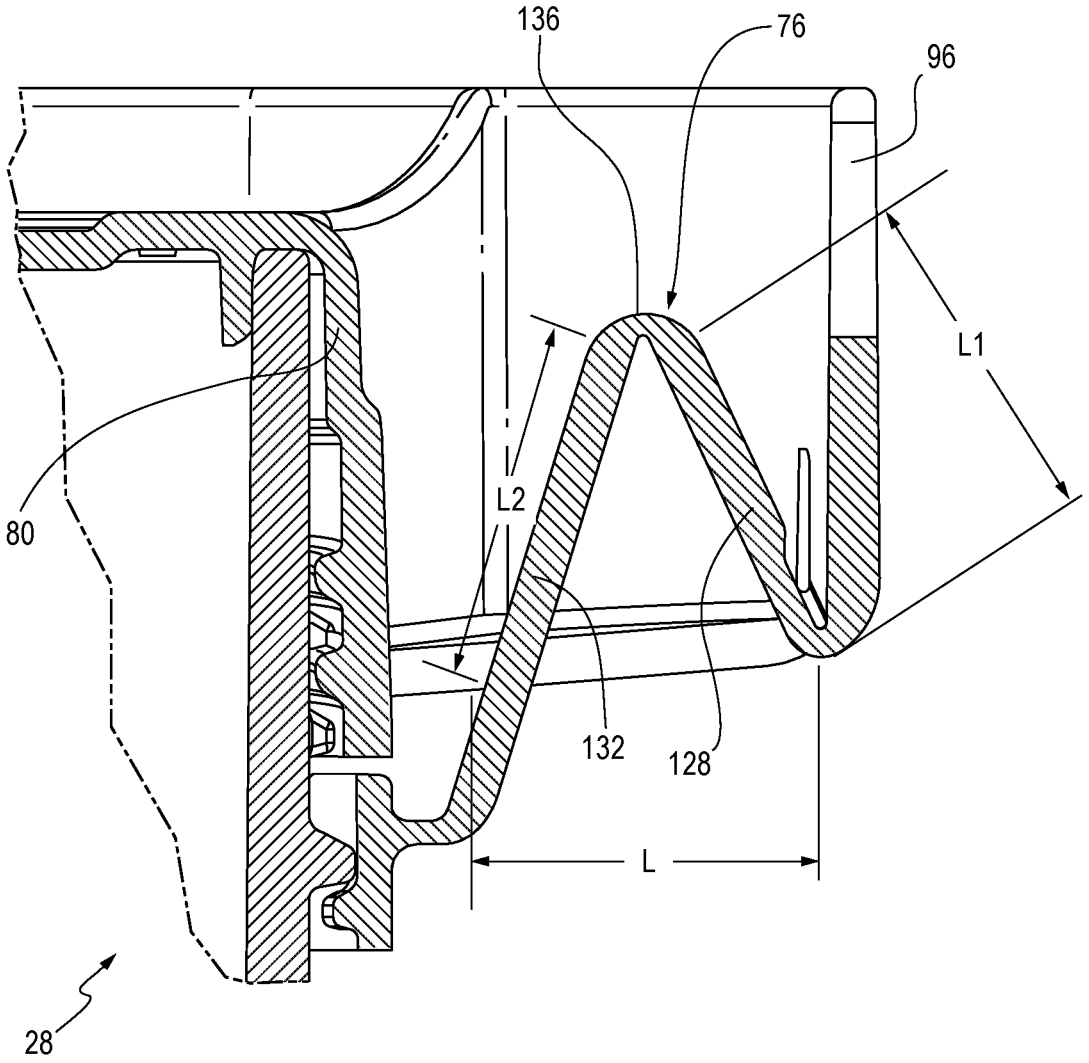
FIG. 4A is a greatly enlarged, fragmentary view of a portion of the closure shown in FIG. 4.

When the closure 20 is in the closed condition, the hinge 136 and major portion 78 of the length of the connecting element 76 is substantially contained or shielded within the first portion 68 of the closing element 28, with no protrusions. This can reduce the risks of damage to the closure 20 during capping, shipping, and handling by the user. With reference to FIG. 4A showing the closed condition of the closure 20, the hinge 136 and the entire length $L_1$ of the first leg 128 are shielded laterally between the outer wall 96 and inner wall 80, and a major portion of the length $L_2$ of the second leg 132 is similarly shielded laterally between the outer wall 96 and inner wall 80. Thus, a major portion of the total length of the entire connecting element 76 (i.e., more than 50%) is shielded laterally between the outer wall 96 and inner wall 80 when the closure 20 is in the closed condition. Further, in the illustrated preferred embodiment in FIG. 4A, when the closure 20 is in the closed condition, the connecting element 76 can be characterized as extending radially between the outer wall 96 and inner wall 80 such that, for a major portion L of that radial distance between the outer wall 96 and inner wall 80, the connecting element 76 is shielded laterally between the outer wall 96 and inner wall 80. It will be appreciated that the connecting element 76 may be designed to have other configurations when the closure 20 is in the closed condition. For example, the sharply angled hinge 136 and straight legs 128 and 132 could instead be replaced with a continuously curving, arch-like structure wherein a major portion of that arch-like structure would be shielded laterally between the outer wall 96 and inner wall 80 when the closure 20 is in the closed condition. The connecting element 76 is designed to unfold in an accordion-like manner to allow for enough length to extend over the spout portion 32 of the body 24 during opening of the closure 20 and further to remain out of the way during dispensing of a substance through the body 24. Importantly, the connecting element 76 may offer improved robustness to survive not only the designed life of the package in which the closure is installed 20, but to survive beyond the designed life of the package to ensure that the closure 20 remains with the package for easier recycling.

In an alternate embodiment of the invention (not illustrated), the bridge or bridges 100 between the inner wall 80 and the outer wall 96 may have the form of an annular transverse wall forming a closed upper end of the closing element 28 between the inner wall 80 and the outer wall 96. In one sense, such a bridge 100 would be an extension of the closed end 88 laterally outwardly to the outer wall 96 in such an alternate embodiment.

In yet another embodiment of the invention (not illustrated), the body thread 44 and closing element thread 46 could be eliminated altogether. In such an embodiment, the user would pull the first portion 68 of the closing element 28 to break the frangible elements 124; however, the plug seal 92 interference within the spout portion 32 of the body 24 would retain the closing element 28 with the body 24 in a closed position for subsequent uses of the closure 20.

Figure 28C:
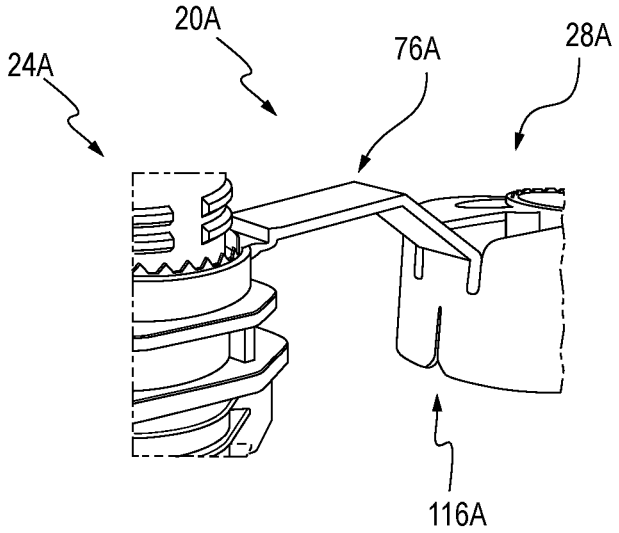
FIG. 28C is a fragmentary, isometric view from above, of a notch of a second embodiment of a closing element according to the present invention and a closure body.
Figure 28D:
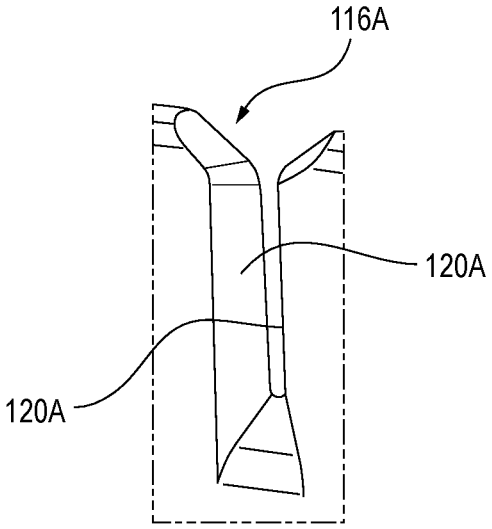
FIG. 28D is a greatly enlarged, fragmentary isometric view from below, of the notch in the outer wall of the closing element of FIG. 28C.

With reference now to FIGS. 28C and 28D, a second illustrated embodiment of the closure according the present invention is designated as 20A. Like elements between the first illustrated embodiment of the closure 20 and the second illustrated embodiment of the closure 20A are designated with the same numeral (the first embodiment having no suffix and the second embodiment having a "A" suffix). The second illustrated embodiment of the closure 20A has the same basic elements, and functions in the same manner, as the first illustrated embodiment of the closure 20. However, the closure 20A includes a modified notch 116A which defines a pair of opposing surfaces 120A that taper in the radially inward direction (through the thickness of the outer wall 96) so as to retain a portion of the container (i.e., sealed edge of a pouch or rigid plastic portion of a bottle, etc.) upon which the closure 20A is installed. In other words, the distance between the opposing surfaces 120A decreases in the direction moving toward the central axis of the closing element 28A when the closing element 28A is assembled to the body 24A in the fully closed condition. When the first portion 68A of the closing element 28A is inverted, this configuration of the notch 116A facilitates the entry of the container portion within the notch 116A.

Figure 28E:
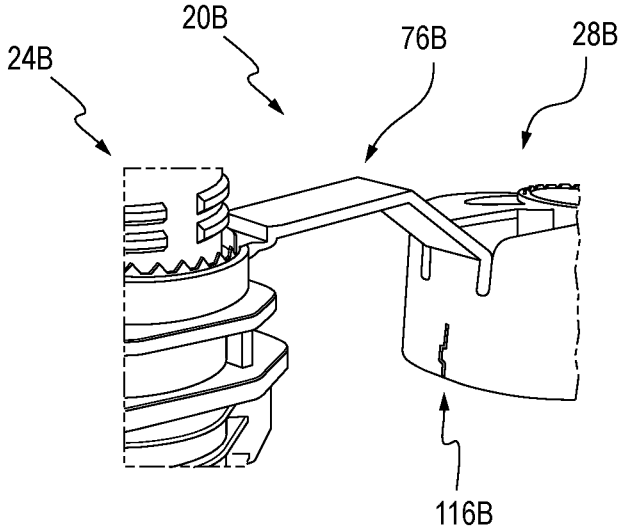
FIG. 28E is a fragmentary, isometric view from above, of a notch of a third embodiment of a closing element according to the present invention and a closure body.
Figure 28F:
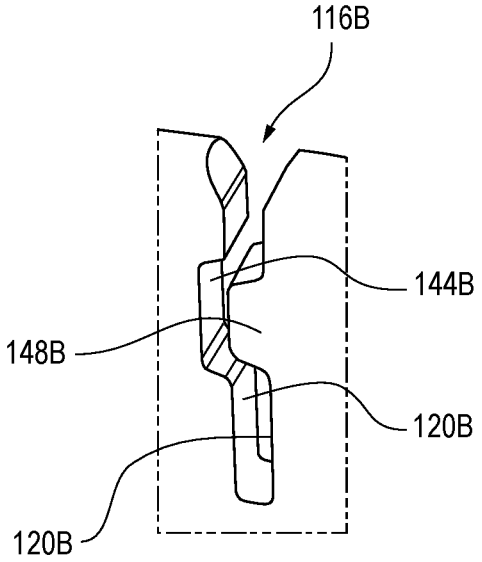
FIG. 28F is a greatly enlarged, fragmentary isometric view from below, of the notch in the outer wall of the closing element of FIG. 28E.

With reference now to FIGS. 28E and 28F, a third illustrated embodiment of the closure according the present invention is designated as 20B. Like elements between the first illustrated embodiment of the closure 20 and the third illustrated embodiment of the closure 20B are designated with the same numeral (the first embodiment having no suffix and the third embodiment having a "B" suffix). The third illustrated embodiment of the closure 20B has the same basic elements, and functions in the same manner, as the first illustrated embodiment of the closure 20. However, the closure 20B includes a modified notch 116B which defines a pair of opposing surfaces 120B, one of which includes a recess 144B and one of which includes a projection 148B located opposite the recess 144B. The recess 144B and projection 148B of the notch 116B function to enhance the frictional engagement between the closure 20B and a portion of the container (i.e., sealed edge of a pouch) upon which the closure 20B is installed.

With reference now to FIGS. 30-36, a fourth illustrated embodiment of the closing element according the present invention is designated as 28C. Like elements between the first illustrated embodiment of the closing element 28 and the fourth illustrated embodiment of the closing element 28C are designated with the same numeral (the first embodiment having no suffix and the fourth embodiment having a "C" suffix). The fourth illustrated embodiment of the closing element 28C has the same basic elements, and functions in the same manner, as the first illustrated embodiment of the closing element 28. However, the closing element 28C has a different ornamental design. Specifically, the outer wall 96C has a uniform, cylindrical shape and is circular when viewed from above.

Figure 42:
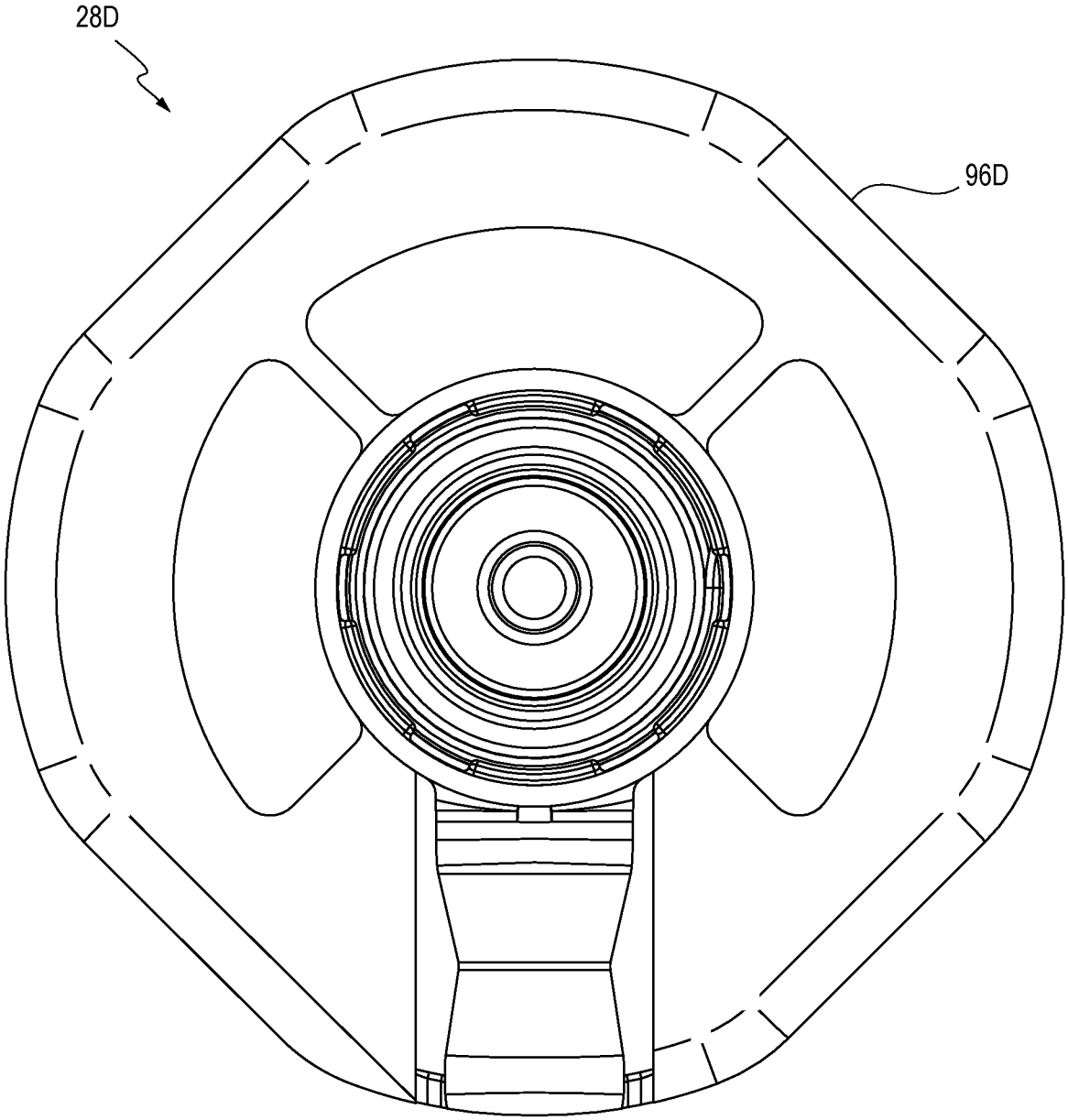
FIG. 42 is a bottom plan view of the closing element of FIG. 37.
Figure 43:
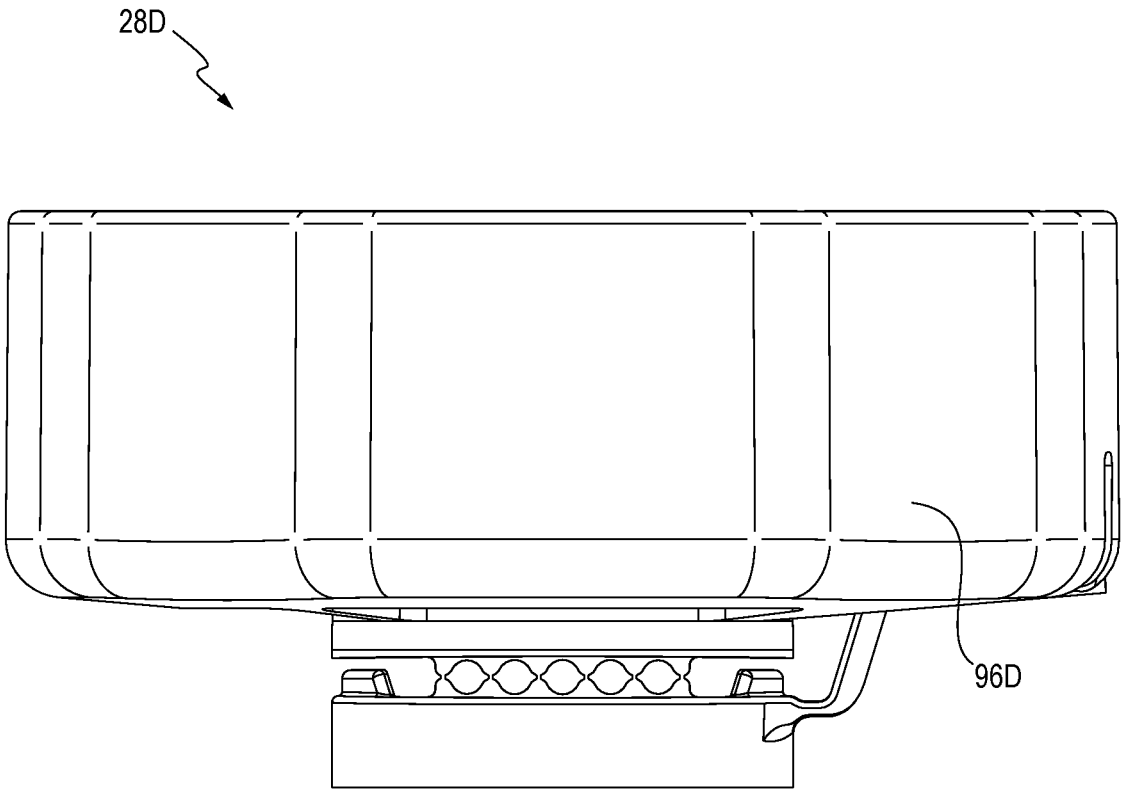
FIG. 43 is a right side elevational view of the closing element of FIG. 37.
Figure 44:
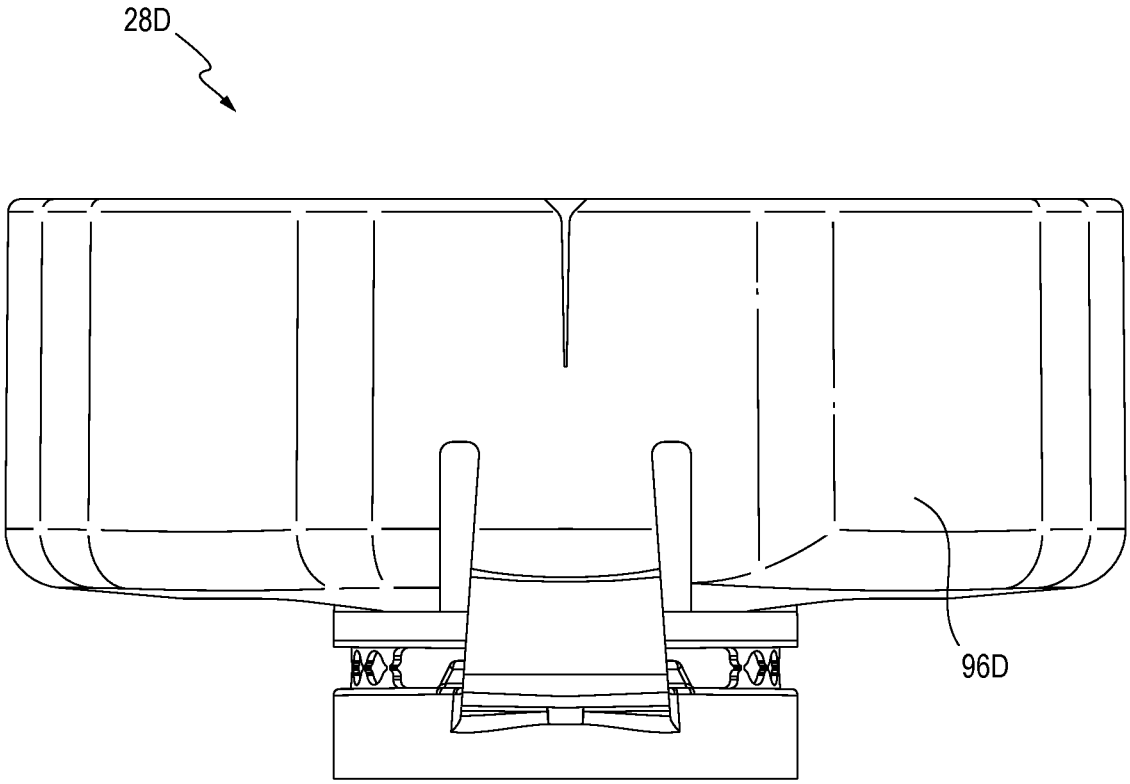
FIG. 44 is a rear elevational view of the closing element of FIG. 37.

With reference now to FIGS. 37-44, a fifth illustrated embodiment of the closing element according the present invention is designated as 28D. Like elements between the first illustrated embodiment of the closing element 20 and the fifth illustrated embodiment of the closing element 28D are designated with the same numeral (the first embodiment having no suffix and the fifth embodiment having a "D" suffix). The fifth illustrated embodiment of the closing element 28D has the same basic elements, and functions in the same manner, as the first illustrated embodiment of the closing element 28. However, the closing element 28D has a different ornamental design. Specifically, the outer wall 96D has a square shape with rounded corners, when viewed from above (FIG. 39) or below (FIG. 42).

Various modifications and alterations to this invention will become apparent to those skilled in the art without departing from the scope and spirit of this invention. Illustrative embodiments and examples are provided as examples only and are not intended to limit the broadest scope of the present invention.

What is claimed is:

1. A closing element for restricting communication of a substance through an access passage of a body, said closing element comprising:

A) a first portion for being removably affixed to the body, said first portion having i) an inner wall having an open end for receiving a portion of the body and having a closed end for occluding the access passage of the body, ii) an outer wall surrounding said inner wall, and iii) at least one bridge connecting said outer wall with said inner wall;

B) a second portion for being non-removably affixed to the body; and

C) a movable connecting element extending between said first portion and said second portion, wherein said closing element has an unactuated configuration wherein a major portion of the length of said connecting element is located laterally between said inner wall and said outer wall to shield said major portion of the length of said connecting element; wherein said outer wall of said first portion has a notch for receiving a part of a container to removably secure said first portion of said closing element to the container; and wherein said notch includes a pair of tapering, opposing surfaces.

2. A method of opening a package, wherein said package includes a container that is a flexible pouch defining an opening to an interior containing a substance, a body sealed at said opening of said flexible pouch and having an access passage to accommodate the communication of the substance through said body, and a closing element assembled with said body to restrict communication of the substance through said access passage of said body, said closing element including a first portion removably affixed to said body, said first portion having an inner wall having an open end receiving a portion of said body and having a closed end occluding said access passage of said body, said first portion further having an outer wall surrounding said inner wall, said outer wall having a notch for receiving a part of the flexible pouch to removably secure said first portion of said closing element to said pouch, said first portion further having at least one bridge connecting said outer wall with said inner wall, said closing element including a second portion non-removably affixed to said body, and a connecting element extending between said first portion and said second portion, the method comprising the steps of:

A) gripping said outer wall of said closing element to move said first portion of said closing element away from said second portion of said closing element and said access passage of said body;

B) inverting said first portion of said closing element; and

C) inserting a part of said flexible pouch within said notch to secure said first portion of said closing element by frictional engagement to said flexible pouch.

* * * * *